US007281964B2

(12) United States Patent
Ito et al.

(10) Patent No.: US 7,281,964 B2
(45) Date of Patent: Oct. 16, 2007

(54) METHOD OF PRODUCING SPACER FOR AN ELECTRON BEAM APPARATUS

(75) Inventors: Nobuhiro Ito, Kanagawa-Ken (JP); Hideaki Mitsutake, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/136,485

(22) Filed: May 25, 2005

(65) Prior Publication Data

US 2005/0253068 A1 Nov. 17, 2005

Related U.S. Application Data

(62) Division of application No. 09/413,773, filed on Oct. 7, 1999, now Pat. No. 6,927,533.

(30) Foreign Application Priority Data

Oct. 7, 1998 (JP) ..... 10-285760
Feb. 26, 1999 (JP) ..... 11-051650
Oct. 4, 1999 (JP) ..... 11-283438

(51) Int. Cl.
*H01J 9/24* (2006.01)
*H01J 9/00* (2006.01)

(52) U.S. Cl. ..... 445/24; 445/25; 313/292

(58) Field of Classification Search ..... 313/495–497, 313/422, 292; 445/24
See application file for complete search history.

(56) References Cited

U.S. PATENT DOCUMENTS 4,904,895 A 2/1990 Tsukamoto et al. ..... 313/336
5,066,883 A 11/1991 Yoshioka et al. ..... 313/309
5,456,961 A * 10/1995 Iida et al. ..... 428/64.4
5,614,781 A 3/1997 Spindt et al. ..... 313/292
5,675,212 A * 10/1997 Schmid et al. ..... 313/422

(Continued)

FOREIGN PATENT DOCUMENTS

JP 64-31332 2/1989
JP 2-257551 10/1990
JP 3-055738 3/1991
JP 4-28137 1/1992
JP 8-180821 7/1996
JP 10-144203 5/1998

OTHER PUBLICATIONS

M. I. Elinson et al., "The Emission of Hot Electrons and the Field Emission of Electrons From Tin Oxide", Radio Engineering and Electronic Physics, Jul. 1965, vol. 10, pp. 1290-1296.
G. Ditmer, "Electrical Conduction and Electron Emission of Discontinuous Thin Films", Thin Solid Firms, 1972, vol. 9, pp. 317-328.
M. Hartwell et al., "Strong Electron Emission From Patterned Tin-Indium Oxide Thin Films", IEEE Trans. ED Conf., 1975, pp. 519-521.

(Continued)

*Primary Examiner*—Sikha Roy
(74) *Attorney, Agent, or Firm*—Fitzpatrick, Cella, Harper & Scinto

(57) ABSTRACT

An electron beam apparatus including a hermetic container provided with an electron source, in which, when a first member is arranged in the hermetic container, at least part of the first member is coated with a film, and the film is configured in such a manner that it includes two regions, a first region and a second region different in electron density from the first region and the second region forms a network in the first region. This three-dimensional network structure allows a member being charged to be preferably controlled. Thereby, it is possible to control the effects of a member being charged which is used in an electron beam apparatus.

9 Claims, 19 Drawing Sheets

U.S. PATENT DOCUMENTS

| | | | | |
|---|---|---|---|---|
| 5,726,529 | A | 3/1998 | Dean et al. | 313/495 |
| 5,746,635 | A * | 5/1998 | Spindt et al. | 445/24 |
| 5,760,538 | A | 6/1998 | Mitsutake et al. | 313/422 |
| 5,811,919 | A | 9/1998 | Hoogsteen et al. | 313/422 |
| 5,892,322 | A * | 4/1999 | Muchi et al. | 313/417 |
| 6,002,198 | A * | 12/1999 | Spindt et al. | 313/292 |
| 6,005,540 | A | 12/1999 | Shinjo et al. | 345/74 |
| 6,013,981 | A | 1/2000 | Spindt et al. | 313/495 |
| 6,153,973 | A | 11/2000 | Shibata et al. | 313/495 |
| 6,157,123 | A | 12/2000 | Schmid et al. | 313/422 |
| 6,200,181 | B1 * | 3/2001 | Narayanan et al. | 445/24 |
| 6,366,014 | B1 * | 4/2002 | Kuroda et al. | 313/495 |
| 6,403,209 | B1 | 6/2002 | Barton et al. | 428/307.7 |
| 6,506,087 | B1 * | 1/2003 | Fushimi et al. | 445/24 |
| 6,759,797 | B2 * | 7/2004 | Tokes et al. | 313/318.01 |
| 6,809,469 | B1 | 10/2004 | Ito et al. | 313/495 |

OTHER PUBLICATIONS

Hisashi Araki et al., "Electroforming and Electron Emission of Carbon Thin Films", J. Vacuum Society of Japan, 1983, vol. 26, pp. 22-29.

W.P. Dyke et al., "Field Emission", Adv. in Electronics and Electron Physics, 1956, vol. 8, pp. 89-185.

C.A. Spindt et al., "Physical Properties of Thin-Film Field Emission Cathodes with Molybdenum Cones", J. Applied Physics, 1976, vol. 47, pp. 6248-6263.

C.A. Mead, "Operation of Tunnel-Emission Devices", J. Applied Physics, 1961, vol. 32, pp. 646-752.

R. Meyer, "Recent Development on 'Microtips' Display at LETI", Tech. Dig. Of IVMC 91, 1991, pp. 6-9.

Abe et al.; "The Effect of Various Factors on the Resistance and TCR of $RuO_2$Thick Film Resistors"; Transactions of the Institute of Electrical Engineers of Japan; vol. 108-A, No. 8, Aug. 1988.

*Lectures on Fundamentals of Electronics Packing Technology*vol. 3, film Circuit Forming Technique, pp. 67-76.

Abe et al., *Factors Affecting Resistance of $R_uO_2$ Thick Film Resistor and TCR*, IEEEJ vol. 108-A, No. 8, Aug. 1988.

* cited by examiner

FIG. 7

SECONDARY ELECTRON EMISSION COEFFICIENT OF DEPENDENCY ON INCIDENT ANGLE $$\frac{\delta\theta}{\delta 0}=\frac{1-\left\{1-\dfrac{m_0\cos\theta}{1+(m1)^{-1}\times(m_0\cos\theta)^{m2}}\right\}\exp(-m_0\cos\theta)}{1-\left\{1-\dfrac{m_0}{1+(m1)^{-1}\times m_0^{m2}}\right\}\exp(-m_0)}\times\frac{1}{\cos\theta}$$

m1=0.68273, m2=0.86212

CALCULATION OF $\delta$ INCIDENT ANGLE DEPENDENCY COEFFICIENT m0 AND INCIDENT ANGLE MULTIPLICATION EFFECT

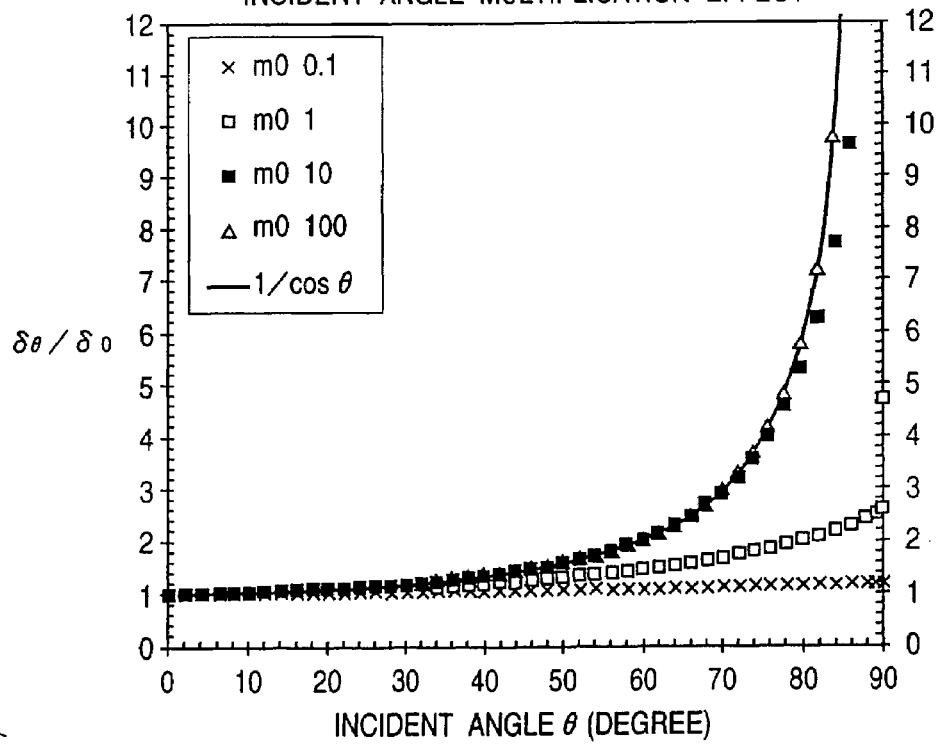

METHOD OF PRODUCING SPACER FOR AN ELECTRON BEAM APPARATUS

RELATED APPLICATION

This application is a divisional of application Ser. No. 09/413,773, filed Oct. 7, 1999 (now U.S. Pat. No. 6,927,533, issued Aug. 9, 2005), the entire contents of which are incorporated herein by reference.

BACKGROUND OF THE INVENTION

1. Field of the Invention

The present invention relates to an electron beam apparatus and an image producer as an application thereof, such as an image display and the like. The present invention also relates to a spacer for use in the electron beam apparatus.

2. Related Background Art

There are two types of electron emission devices currently known: a hot cathode element and a cold cathode element. As to the latter, the known elements include, for example, surface conduction type electron emission devices, field emission elements (hereinafter referred to as an FE type) and metal-insulating layer-metal type electron emission devices (hereinafter referred to as an MIM type).

The surface conduction type electron emission devices currently known include, for example, one disclosed by M. I. Elinson in Radio Eng. Electron Phys., 10, 1290, (1965), and the others described below.

The surface conduction type electron emission devices take advantage of the phenomenon that electron emission occurs on the thin film of a small area formed on the substrate when applying electric current parallel to the surface of the film. There are several types of surface conduction type electron emission devices reported, in addition to the aforesaid element by Elinson et al. which utilizes $SnO_2$ thin film: one utilizing Au thin film (refer to G. Dittmer: "Thin Solid Films," 9, 317 (1972)), one utilizing $In_2O_3/SnO_2$ thin film (refer to M. Hartwell and C. G. Fonstad: "IEEE Trans. ED Conf.," 519 (1975)), and one utilizing carbon thin film (refer to Hisashi Araki et al. "Vacuum," Vol. 26, No. 1, 22 (1983)).

FIG. 23 shows a plan view of the aforementioned element by M. Hartwell et al. as a typical example illustrating the construction of the surface conduction type electron emission devices. In the figure, reference numeral 3001 designates a substrate and numeral 3004 designates a conductive thin film consisting of metal oxide and formed by sputtering. The conductive thin film 3004 is in the form of an H-shaped plan as shown in the figure. An electron emission portion 3005 is formed by conducting an energization treatment, known as energization forming which is to be described below, to the above conductive thin film 3004. The spacings L and W in the figure are set for 0.5 to 1 [mm] and 0.1 [mm], respectively. For convenience's sake, in the above figure the electron emission portion 3005 is shown in the center of the conductive thin film 3004 in the form of a rectangle. The figure is, however, very schematic and does not necessarily represent the actual position and form of the electron emission portion.

In the aforesaid surface conduction type electron emission devices, including one by M. Hartwell, it has been common that the electron emission portion 3005 is formed by conducting an energization treatment, called energization forming, to the conductive thin film 3004 prior to the execution of electron emission. Energization forming used herein means that a constant direct-current voltage or a direct-current voltage stepping up at a very slow rate of, for example, about 1 V/min is applied to both ends of the conductive thin film 3004 to pass a current therethrough and cause a local fracture, deformation or change in quality therein, so as to form the electron emission portion 3005 in a highly resistive state. In some part of the conductive thin film 3004 having undergone a local fracture, deformation or change in quality, a crack is to appear. When applying a proper voltage to the conductive thin film 3004 after the above energization forming, electric emission occurs in the vicinity of the above crack.

The known FE type elements include, for example, one disclosed by W. P. Dyke & W. W. Dolan in "Field Emission," Advance in Electron Physics, 8, 89 (1956) and one disclosed by C. A. Spindt in "Physical Properties of Thin-Film Field Emission Cathodes with Molybdenium cones," J. Appl. Phys., 47, 5248 (1976).

FIG. 25 shows a sectional view of the aforementioned element by C. A. Spindt et al. as a typical example illustrating the configuration of FE type elements. In the figure, reference numeral 3010 designates a substrate, numeral 3011 an emitter wiring consisting of a conductive material, numeral 3012 an emitter cone, numeral 3013 an insulating layer and numeral 3014 a gate electrode. In this element, field emission is caused at the tip portion of the emitter cone 3012 by applying a proper voltage between the emitter cone 3012 and the gate electrode 3014.

There is another example of the construction of FE type elements where, unlike the laminated structure shown in FIG. 25, an emitter and a gate electrode are arranged on the substrate almost parallel to the substrate plane.

The known MIM type elements include, for example, one disclosed by C. A. Mead in "Operation of Tunnel-Emission Devices," J. Appl. Phys., 32, 646 (1961). FIG. 26 shows a typical example of the construction of MIM type elements. The figure is a sectional view, in which reference numeral 3020 designates a substrate, numeral 3021 a lower electrode consisting of metal, numeral 3022 a thin insulating layer about 100 A thick and numeral 3023 an upper electrode about 80 to 300 A thick consisting of metal. In MIM type elements, electron emission is caused on the surface of the upper electrode 3023 by applying a proper voltage between the upper electrode 3023 and the lower electrode 3021.

The aforementioned cold cathode elements do not need a heater for heating their cathode since they allow electron emission to occur at a lower temperature than hot cathode elements. Accordingly, their structure can be simpler than that of hot cathode elements, which allows fine elements to be produced. Further, when multiple elements are densely arranged, problems such as melting substrate by heat and the like are unlikely to occur. In addition, unlike the hot cathode elements, which are slow at response because they operate only after heated with a heater, the cold cathode elements have the advantage of being quick at response.

Thus, a lot of studies have been conducted for the application of cold cathode elements.

A surface conduction type electron emission device, for example, has a particularly simple structure and is easy to produce compared with the other cold cathode elements, accordingly the application of this type elements is advantageous to forming multiple elements over a large area of the substrate. Therefore, methods have been studied to arrange and drive multiple elements on the substrate, as disclosed, for example, by the present applicants in Japanese Patent Application Laid-Open No. 64-31332.

As to the application of surface conduction type electron emission devices, the studies have been carried out of, for example, image producer such as an image display and an image recorder, charged beam sources and the like. For the application to an image display, the display using surface conduction type electron emission devices in combination with a fluorescent substance, which emits light when electron beam is applied, has been studied as disclosed by the present applicants in U.S. Pat. No. 5,066,883, Japanese Patent Application Laid-Open No. 2-257551 and Japanese Patent Application Laid-Open No. 4-28137. An image display using surface conduction type electron emission devices in combination with a fluorescent substance is expected to have properties superior to conventional ones using other methods. The above display may be superior to, for example, the liquid crystal display which has been in common use recently in that it does not need a backlight since it spontaneously emits light and in that it has a wide viewing angle.

A method for arranging and driving multiple FE type elements is disclosed, for example, by the present applicants in U.S. Pat. No. 4,904,895. The known examples of the application of FE type elements to an image display include, for example, a planar image display reported by R. Meyer et al. (refer to R. Meyer: "Recent Development on Micro-Tips Display at LETI," Tech. Digest of 4th Int. Vacuum Microelectronics Conf., Nagahama, pp. 6-9 (1991)).

An example of the application of multiple MIM type elements in the arranged state to an image display is disclosed by the present applicants in Japanese Patent Application Laid-Open No. 3-55738.

Among the image producer using the electron emission devices described above, a planar image display which is thin depthwise has attracted considerable attention as a replacement of the image displays utilizing cathode-ray tubes, since it is space-saving and lightweight.

FIG. 27 is a perspective view of one example of the display panel constituting a planar image display, partially broken away to show the inside structure.

In the figure, reference numeral 3115 designates rear plate, numeral 3116 a side wall and numeral 3117 a face plate. And the rear plate 3115, the side wall 3116 and the face plate 3117 make up an outer enclosure (hermetic container) for keeping the inside of the panel cell vacuum. On the rear plate 3115 a substrate 3111 is fixed, while on the substrate 3111 N×M cold cathode elements are formed (wherein N, M are positive integers not lower than 2 and they are properly set according to the number of pixels to be displayed). The above N×M cold cathode elements 3112 are wired with M lines of row wiring 3113 and N lines of column wiring 3114 as shown in FIG. 27. The portion consisting of the substrate 3111, the cold cathode elements 3112, the row wiring 3113 and the column wiring 3114 is referred to as a multiple electron beam source. Between the row wiring 3113 and the column wiring 3114 an insulating layer (not shown in the figure) is formed at least at each portion where the row wiring intersects the column wiring. As a result, the row wiring 3113 and the column wiring 3114 can be kept electrically separated from each other.

On the underside of the face plate 3117, a fluorescent film 3118 is formed which consists of fluorescent substances of three primary colors: red (R), green (G) and blue (B) (not shown in the figure). Between adjacent fluorescent substances each of which is colored in any one of the above primary colors and constitutes the fluorescent film 3118, a black substance (not shown in the figure) is provided. And on the surface of the fluorescent film 3118 which faces the rear plate 3115, a metal back 3119 consisting of Al and etc. is formed.

Dx1 to Dxm, Dy1 to Dyn and Hv are electrical connection terminals having a hermetic structure for electrically connecting the above display panel with an electric circuit, which does not appear in the figure. Dx1 to Dxm, Dy1 to Dyn and Hv are electrically connected with the raw wiring 3113 of the multiple electron beam source, the column wiring 3114 of the multiple electron beam source and the metal back 3119, respectively.

The interior of the above hermetic container is kept at a vacuum of about $10^{-6}$ Torr ($1.33\times10^{-4}$ Pa). As the display area of the image display becomes larger, some means becomes necessary to prevent the rear plate 3115 and the face plate 3117 from undergoing deformation or fracture due to the difference in atmospheric pressure between the interior and the exterior of the hermetic container. The use of the method in which the rear plate 3115 and the face plate 3117 are made thicker not only increases weight of the image display, but causes distortion of images as well as parallax when viewing the display at an angle. Contrary to this, in FIG. 27 are provided structural supports (referred to as spacer or rib) 3120 made of a relatively thin glass plate for supporting atmospheric pressure. The spacing between the substrate 3111, which has a multiple electron beam source formed on it, and the face plate 3117, which has a fluorescent film 3118 formed on it, is usually kept submillimeter to several millimeters, and the interior of the hermetic container is kept at a high vacuum as described above.

When applying voltage to each cold cathode element 3112 in an image display with the display panel described above through the terminals, Dx1 to Dxm and Dy1 to Dyn, outside the container, electrons are emitted from each cold cathode element 3112. At the same time, a high voltage of several hundreds-volt to several-kilovolt is applied to the metal back 3119 through the terminal Hv outside the container to accelerate the emitted electrons above and force them to collide with the internal surface of the face plate 3117. This allows each colored fluorescent substance constituting the fluorescent film 3118 to be excited and emit light, as a result of which images are displayed.

The display is disclosed in U.S. Pat. No. 5,083,058 which uses glass containing, for example, ruthenium oxide for its struts and is the background art of the present invention.

The aforementioned display panel for image displays has, however, the following problems. First, the spacer 3120 may be charged when some of the electrons emitted from its vicinity hit it or when the ions emitted due to the action of the emitted electrons deposit to it. The orbit of the electrons emitted from the cold cathode element 3112 is deformed due to the charged spacer, so that the electrons reach the place other than the normal one, which leads to the distortion of the image in the vicinity of the spacer.

Second, there is a fear that a creeping discharge should occur along the surface of the spacer 3120 disposed between the multiple electron beam source and the face plate 3117, since a high voltage of several hundreds-volt or higher (that is, a high electric field of 1 kV/mm or higher) is applied therebetween to accelerate the electrons emitted from the cold cathode element 3112. An electric discharge is likely to be induced, particularly when the spacer is in the charged state as described above.

In order to solve this problem, there is proposed a method in U.S. Pat. No. 5,760,538 in which the electrical charge contained in spacers be neutralized by passing an infinitesimal current therethrough. In the above patent, an infinitesimal current is allowed to pass through the surface of the spacers by forming a highly resistant thin film as an antistatic film thereon. The antistatic film used in the above patent is a thin film of tin oxide, a mixed crystal thin film of tin oxide and indium oxide, or a metal thin film.

The use of the method in which electrical charge is neutralized with a highly resistant thin film sometimes leaves the problem of insufficient reduction of image distortion unsolved. The principal factor underlying this problem is considered to be the concentration of electrical charge in the vicinity of the junction portion due to the insufficient electrical junction between the spacers with a highly resistant thin film and the upper and lower substrates, that is, the face plate (hereinafter referred to as "FP") and the rear plate (hereinafter referred to as "RP"). In order to solve this problem, there is proposed a method in which the end faces of the spacer facing FP and RP, respectively, are coated with the material whose resistivity is lower than a metal thin film or a highly resistive film within the range of about 100 to 1000 micron so as to ensure its electrical contact with the upper and lower substrates and control its electrification due to the incidence of the reflected electrons from the face plate, as disclosed in Japanese Patent Application Laid-Open No. 8-180821 and Japanese Patent Application Laid-Open No. 10-144203.

Even with such a means given to the highly resistive film and the means for controlling the orbit of emitted electrons, as well as with the formation of low resistive film portion for a better electrical contact as described below, electrification of the spacers cannot be sufficiently controlled depending on the other design parameters of the electron beam apparatus, such as materials and film thickness of its face plate, shape, and anode accelerating voltage, and there still exist problems of, for example, displacement of light emitting points and occurrence of an infinitesimal discharge in the vicinity of the spacers due to the insufficient control.

The cause of such electrification is not clarified in detail, it is, however, considered that the factors lie upon the following background.

Presumably, the cause of electrification of the spacers is such that there may exist some factors which effectively increase the capacitance and resistance of the spacers as described below, or the spacers are exposed to the reflected electrons from the cold cathode elements 3112 close thereto other than the most closest ones during their non-selective period and also exposed to the abnormal field emission from the field concentration region in the vicinity of the spacer-cathode junction. In addition, it is considered to be another cause of the electrification that control of the secondary emission coefficient on the surface of the spacers is not accounted for in design.

[Background 1] Restriction by the Relaxation Time Constant of a Highly Resistive Film on Spacers The progress of electrification and relaxation in any region of the surface of a spacer can be considered as a time delay of the charged electric potential corresponding to the injection current by the application of a charged dielectric model.

FIG. 4 illustrates a model which represents the relaxation by capacitance resistant elements in the case of looking at upper and lower electrodes from a current injection region, when an effective injection current ic is supplied from a current source to an arbitrary position z on the surface of a spacer. In the figure, Va designates a voltage applied from a voltage source to an anode and ic an effective injection current supplied to the position at a height of zh (wherein h corresponds to the height of a spacer, $0<z<1$). The effective injection current corresponds to the difference between a secondary current and a primary current. C1 and R1 designate values of capacitance and resistance, respectively, which specify the relaxation time constant between the injection region and the anode, while C2 and R2 values of capacitance and resistance, respectively, which specify the relaxation time constant between the injection region and the cathode. When the resistance and the capacitance distribute uniformly in the altitude direction, C1, C2, R1 and R2 are described using the resistance of the spacer R and the capacitance C by $C/(1-z)$, $R(1-z)$, $C/z$ and $Rz$, respectively.

Since the principle of superposition should hold for the injection current in any position, the electric potential in the region of an arbitrary altitude on the spacer can be specified without losing generality if considering the electrification process in the following manner; first a high voltage Va from a voltage source is applied between the anode and the cathode, then the electronic current entering from the vacuum side to the position z in the aimed region is treated as an effective injection current Ic which is equivalent to the difference between the entered and emitted currents, and finally performing formularization with an equivalent circuit to which the effective injection current Ic as a current source is supplied, as shown in FIG. 4.

Now, in order to design a suitable spacer construction, formularization of a relaxation process will be performed taking a concrete example of the charged electric potential on the spacer having an insulating or highly resistive film formed on it and suitable for the electron beam emission apparatus of the present invention. For simplification, it is assumed that distribution of electric constant is uniform on the surface of the spacer. First, formularization is performed treating the rate of effective injection charge to the surface of the spacer as amount of current supplied from a current source and taking into account the energy distribution and incident angle distribution of incident electrons. The result is as follows:

amount of electronic current emitted from the electron emission device Ie proportion of the incident electrons at an altitude of zh ($0<z<1$) $\beta^{ij}$ secondary electron emission coefficient at an altitude of zh ($0<z<1$) $\delta^{ij}$ provided that superscripts i, j correspond to incident energy and incident angle, respectively, amount of primary electronic current in the position z Ip $$Ip=\Sigma\Sigma Ip^{ij}=\Sigma\Sigma\beta^{ij}\times Ie$$

amount of secondary electronic current in the position z Is $$Is=\Sigma\Sigma\delta^{ij}\times Ip^{ij}=\Sigma\Sigma\delta^{ij}\times\beta^{ij}\times Ie$$

injection rate of the electrical charge in the position z Ic $$Ic=\Sigma\Sigma(\delta^{ij}-1)\times Ip^{ij}=\Sigma\Sigma(\delta_{ij}-1)\times\beta^{ij}\times Ie$$

Finally, the rate of injection charge Ic can be described as $$Ic=P\times Ie \qquad \text{General Formula (2)}$$

wherein P is described as $P=\Sigma\Sigma(\delta^{ij}-1)\times\beta^{ij}$ and is a coefficient independent of Ie, it is, however, assumed that in reality P changes as the progress of electrification.

Then, for the arrangement of the capacitance and resistance of the spacer film seen from the injection region, it is assumed for simplification that there exists neither resistance variation nor capacitance variation in the altitudinal direction of the spacer (this corresponds to the direction in which a high voltage is applied between anode and cathode). At this time, when the resistance and capacitance in the direction parallel to the surface of the spacer seen from anode/cathode are represented by R and C, the altitude of the spacer h, and the altitude of the injection region zh ($0\leqq z\leqq 1$, on the anode side z=1), the electric constant existing above and below the injection region is specified for the position z. Further, since a voltage from the voltage source is applied between the anode and the cathode, an effective impedance Z is dealt with as 0. Thus, it is understood that the injected electrical charge undergoes relaxation through the parallel resistance and the parallel capacitance of each resistance and capacitance lying above and below the injection region. The resistance and the capacitance between the injection region in the position z and GND are described by z(1−z)R and C/z+C/(1−z), respectively, and response time constant τ of relaxation path corresponds to the product of the original resistance and capacitance of the spacer, that is, CR.

The electric potential in any position at this time is described as a function of time using the solution obtained by setting up a differential equation concerning a current for the entire close of the aforementioned equivalent circuit shown in FIG. 4.

When the time of starting electron emission is shown by t=0, provided that electron emission device is continuously driven, ΔV(t) which represents the progress of charged electric potential in the injection region is described by the following equation, $$\Delta V(t)=z(1-z)Ri_e(1-\exp(-t/\tau)) \qquad \text{General Formula (3)}$$

and it is clear that the progress of charged electric potential depends on the product of the resistance R and effective injection current Ic.

When plotting time in abscissa and the amount of the emission current from electron emission device and the time of emitting the charged electric potential electrons on the spacer in ordinate, setting quiescent time (that is, selective period, non-selective period) for t1 seconds, and repeating the drive of the element every t2 seconds, as shown in FIG. 5, the charged electric potential ΔV at the end of the first period (t1+t2 seconds) is described using the general formula (3) as follows:

$$\Delta V(t)=z(1-z)Ri_e(1-\exp(-t_1/\tau))\exp(-t_2/\tau) \qquad \text{General Formula (4)}$$

And it is assumed that electrical charge is accumulated every time the elements close to the spacer are driven, provided that t2>>τ or t1<<τ does not hold. The relaxation process of electrification of the spacer is thus described.

On the other hand, the change in the position of a beam with the amount of electrons emitted during the selective period t1 (Duty dependency) is a problem for a display device, however such Duty dependency in the light emitting position can be dealt with as a change of ΔV shown by the general formula (3) corresponding to the amount of emitted electrons (the product of Ie and pulse width), accordingly both sides of the general formula (3) are differentiated by the amount of emitted electrons (the product of Ie and pulse width).

$$\frac{d\Delta V(t)}{d(I_e t_1)} = z(1-z)R\left\{\frac{P(1-\exp(-t_1/\tau))}{tI} + \frac{P\exp(-t_1/\tau)}{\tau}\right\} = \frac{z(1-x)}{C}\frac{P}{t_1}\{\tau+(t_1-\tau)\exp(-t/\tau)\} \qquad \text{General Formula (5)}$$

The general formula (5) is simplified by the driving conditions and the material constant. When the material is insulating or selective period is very short, CR=τ>>t1 holds, and the following formula is established.

$$\frac{d\Delta V(t)}{d(I_e t_1)} = \frac{z(1-z)P}{C} \qquad \text{General Formula (6)}$$

When the material is low resistant or selective period is very long, CR=τ<<t1 holds, and the following formula is established.

$$\frac{d\Delta V(t)}{d(I_e t_1)} = \frac{z(1-z)PR}{t_1} \qquad \text{General Formula (7)}$$

Now parameters specifying Duty dependency in the light emitting position, that is, tone dependency during the selective period will be explained based on the above formularization.

In terms of the conditions under which an accelerating voltage between anode and cathode is maintained, preferably a spacer has some degree of insulating property or high resistance in the direction parallel to its surface. Accordingly, when taking into account Duty dependency of charged electric potential in any position, preferably the general formula (6) is applied. Thus, in order to control Duty dependency, dielectric constant or the section area of the spacer material needs to be enlarged. The controllable range of dielectric constant in material is, however, extremely limited compared with specific resistance, and as for film thickness, it is impossible to ensure an effective dimension for the reason related to processes. Thus, control of parameter P is required.

Further, in terms of the increase in effect of electrification relaxation during quiescent time, if electrons are injected into a spacer in a repetition period shorter than the time constant specified by resistance and capacitance, charges are accumulated, as described with respect to the above general formula (4). Even when the material is applied to the highly resistive film on the surface of the spacer whose relaxation time constant is smaller than the line non-selective period of electron emission device t2 second (≈selective period×the number of scanning lines), cumulative charge can be formed. Thus the design of relaxation time τ aiming at control of the resistance alone is considered to be insufficient for antistatic measures.

In any case, it is difficult to design suitable conditions under which electrification is restricted as long as control of resistance and capacitance alone is aimed at, for this purpose, the control of secondary electron emission coefficient is required

[Background 2] Generally secondary electron emission coefficient largely depends on the incident angle of incident electrons, and secondary electron emission coefficient δ doubles almost exponentially by enlarging the incident angle.

Generally, in cases where primary electrons enter the smooth surface as shown in FIG. 14, when the incident angle is represented by θ [degree] (−90<θ<90), incident energy by Ep [keV], the distance incident electrons penetrate into the film by d [Å], absorption coefficient of secondary by α [1/Å], the mean energy of primary electrons needed for the generation of secondary electrons in the film by ξ [eV] and the probability of secondary electrons escaping from the surface to vacuum by B, secondary electron emission coefficient is quantitatively described using parameters A, n describing the energy loss process of primary electrons in the film by the following general formula (0).

$$\delta = \frac{B}{4\xi}\left(\frac{An}{\alpha'}\right)^{\frac{1}{n}}(\alpha' d_p)^{\frac{1}{n}-1}\left[1 - \left\{1 + \left(\frac{1}{\gamma} - 1\right)\alpha' d_p\right\}\exp(-\alpha' d_p)\right] \quad \text{General Formula (0)}$$

wherein parameters α, γ, dp are specified by the following relationship:

$$\alpha' = \alpha\cos\theta \quad \text{General Formula (0')}$$

$$\gamma = 1 + m_1 \times (\alpha' d_p)^{-m_2},$$

$$m_1 = 0.68273,\ m_2 = 0.86212$$

$$dp = \frac{E_p^n}{An}$$

The incident energy dependency of secondary electron emission energy shown by the above general formula (0) generally has an angle property with peaks, and in many cases, it has two incident energies with which the peak value of secondary electron emission coefficient δ exceeds 1 and the relation δ=1 is satisfied. In the incident energy between these two cross-point energies, secondary electron emission coefficient is positive, which means the generation of positive charge. Of the two cross-point energies, the smaller one is referred to as a first cross-point energy E1 and the bigger one a second cross-point energy E2.

Here, the incident angle dependency of secondary electron emission coefficient standardized in the general formula (0) for the vertical incidence of 0 degree, that is, θ=0 can be an index for evaluating the secondary electron emission multiplication effect at an angle.

This is shown below as a general formula (1), $$\frac{\delta_\theta}{\delta_0} = \frac{1 - \left\{1 - \frac{m_0\cos\theta}{1 + (m_1)^{-1} \times (m_0\cos\theta)^{m_2}}\right\}\exp(-m_0\cos\theta)}{1 - \left\{1 - \frac{m_0}{1 + (m_1)^{-1} \times m_0^{m_2}}\right\}\exp(-m_0)} \times \frac{1}{\cos\theta} \quad \text{General Formula (1)}$$

wherein parameters $m_1$, $m_2$ are constants having the following values:

$m_1$=0.68273, $m_2$=0.86212

In the general formula (1), $m_0$ is equal to and which is the product of the absorption coefficient of secondary electrons α and the penetration distance of primary electrons d, is a function of incident energy, and can be a positive real number. Hereinafter $m_0$ is referred to as incident angle multiplication coefficient of secondary electron emission coefficient, because of its characteristics. In the above general formula (1), $m_0$ shows a tendency to increase monotonously with the incident angle |θ| under arbitrary incident energy conditions, then rapidly increases where the incident angle becomes about 90 degrees. This is because the primary electrons enter the surface at an angle and the distribution of the secondary electron generating sites shifts near to the surface of the film. For this reason, the proportion of the electrons increases which are emitted into vacuum without recombining and therefore vanishing. This can be understood as an apparent reduction of the absorption coefficient of secondary electrons α to αcosθ. In the smooth thin film formed on the smooth surface of a spacer as a spacer material, for example, many antistatic films have an incident angle multiplication coefficient of secondary electron emission coefficient $m_0$ larger than 10, provided that the incident energy having a positive secondary electron emission coefficient, which is larger than the first cross-point energy and smaller than the second cross-point energy, is 1 keV. This increases the positive electrification with the increase in the incident angle and is the big cause of the positive electrification of the spacer material. The enlarged incident angle multiplication effect of secondary electron emission coefficient is shown in FIG. 7 with black boxes.

[Background 3] The distribution of the incident angle to a spacer is large, in addition, the incident electrons entering the surface at a large incident angle are predominant.

There exist various routes for the electrons' incidence, they are, however, represented roughly by three particular routes. The first one is a direct incidence of the electrons emitted from electron emission devices. In this case, the incident angle is as large as about 80 to 86 degrees, though it depends on the degree of distortion in the electric field near the spacer and other designed values of the apparatus, and its incident mode is a large incident angle and high incident energy. Further, it has a feature such that, since the distance between the spacer and electron emission device close thereto is short, the amount of incident electrons is very large. The second one is an indirect incidence of the electrons reflected from a face plate to its surroundings. In this route, the distribution of the incident angle expands from 0 to large degrees, and the incident energy also has a distribution, but its range is smaller than that of the incident energy in the first route. The third one is re-incidence to the surface of the spacer of the incident electrons of the first and the second routes or the electrons emitted from field concentration points. This route is considered to occur because electrons are apt to re-enter the region in the locally positively charged state compared to other regions. In this case also, the incident angle has a distribution. Since a high electric field of about several kV/cm to several tens kV/cm is usually applied in the creeping direction as an accelerating voltage, the vertical incidence of electrons is modulated to an incidence at a large angle. Thus, incident electrons passing through any route have an incident angle distribution, and an effective charge injection is performed through the positive charge formed inside of a solid by the incident electrons entering at a large angle. Of the incident modes described above, the direct incident electrons of the first route is usually predominant over the positive charge in question, they are, however, dependent on the driving state and the design of electron emission device, and they can sometimes leave the problem unsolved of the reflected electrons from a face plate and the re-incidence of multiple scattered electrons described below.

[Background 4] Multiple Electron Emission on the Surface

The secondary electrons once emitted from the surface of a spacer have a relatively small initial energy of at most 50 eV. Although in space they receive energy from the electric field between the anode and cathode, since situations in which the spacer is charged positively often occur, there exist many electrons plunging into the positively charged region on the spacer as well as the electrons reaching the anode. These electrons are problematic because they accumulate the positive charge on the spacer cumulatively while repeating their incidence at a low incident energy and a large incident angle and emission alternately. Thus, control of the above multiple electron emission is the subject for study.

Now the above backgrounds will be abstracted. As apparent from Background 1, there are some cases where the film designed taking into account resistant value alone is not perfect since the range within which the dielectric constant and resistant value of the film can be selected is restricted, and in such a case it is important to restrict the amount of effective current injected into the film, or to restrict secondary electron emission coefficient.

As apparent from Backgrounds 2 and 3, in the design of the spacer's surface the reduction of incident angle dependency of secondary electron emission coefficient and the absolute value thereof is a subject, since electrification by the electrons with a large incident angle is predominant over the real electron emission devices. Further, Background 4 shows that it is important to reduce the cumulative emission phenomenon of electrons to control the cumulative positive accumulation of multiple scattered electrons. These are the subjects of the art of the present invention.

As described so far taking a spacer for example, there are some cases where there exists a member in a hermetic container within an electron emission apparatus which may be exposed to electrons, and the effect of the member due to its electrification is desired to be relaxed. The effects include, for example, variation of the position exposed to the electrons and occurrence of creeping discharge. The present patent application provides an invention which implements a construction enabling the relaxation of the above effects.

SUMMARY OF THE INVENTION

Empirically, the above formulae (0) and (1) are satisfied in almost all the materials, and the incident angle multiplication coefficient of secondary electron emission coefficient $m_0$ is obtained by fitting experimental values in the general formula (1). $m_0$ can be used as an index of incident angle dependency of secondary electron emission coefficient since it is highly reproductive.

According to the present inventors' detailed examination, many inorganic materials having a low secondary electron emission coefficient which have been considered to be suitable for spacers show a strong incident angle dependency and have an incident angle multiplication coefficient of secondary electron emission coefficient $m_0$ of 10 or larger. This is a significant cause of positive electrification of spacers within image displays of the electron beam emission type where many electrons enter the surface of the spacer at an angle.

[Ideal State Derived from Theoretical Equation]

What should be done to reduce incident angle multiplication coefficient of secondary electron emission coefficient $m_0$ as well as to reduce secondary electron emission coefficient $\delta 0$ for the vertical incidence? After the present inventors' detailed examination, it was found that the above subject can be accomplished by satisfying the following requirements. Specifically, it is considered that the methods grouped into two major categories can be used in order to relax incident angle dependency.

Those are the methods for relaxing the uniformity of incident angle itself and for reducing surface effect as a property on material side, that is, the ratio of penetration depth of primary electrons to penetration depth of secondary electrons: $d/\lambda$.

(1) Dispersion of Incident Angle of Primary Electrons

Incident angle is allowed to have an infinitesimal distribution in the normal direction on the interface considered as a surface, so that it is not restricted to the angle specified by the outside. Thus the incident angle defined on a local basis has a distribution with respect to the angle defined on a broader basis, which allows dependency on incident angle to be relaxed. Since dependency on incident angle shows the property of rapidly increasing when incident angle is close to 90 degrees, relaxation by the dispersion of incident angle is significantly effective.

(2) Reduction of the Ratio of Penetration Depth of Primary Electrons to Penetration Depth of Secondary Electrons Since the penetration depth of electrons into a solid is proportional to the reciprocal of free electron density $\rho Z_{eff}/A_{eff}$, a larger free electron density makes possible a smaller incident angle multiplication coefficient of secondary electron emission coefficient $m_0$. In the elements other than hydrogen, values of $Z_{eff}/A_{eff}$ are in the range of 2 to 2.5, and since its variation is smaller than that of $\rho$, the penetration depth is specified by the specific gravity $\rho$ of each solid. In other words, when primary electrons have an equal incident energy, their penetration depth becomes smaller in the film having a larger density $\rho$. Then, since $m_0=d/\lambda$ (wherein $\lambda$ is escape depth of secondary electrons, $\lambda=1/\alpha$), the restriction of incident angle multiplication coefficient of secondary electron emission coefficient $m_0$ is understood as the restriction of the ratio of penetration depth of primary electrons to penetration depth of secondary electrons within the medium.

In a uniform single material system, however, it is very difficult to control the relationship between $\lambda$ and d independently. After the present inventors' examination, it was found that, provided that the spacer undergoes positive electrification which is the main subject when considering the electrification of the spacer, incident angle multiplication coefficient of secondary electron emission coefficient $m_0$ often has a value of 10 or larger for the primary electrons whose incident energy is the first cross-point energy E1 or more and the second cross-point energy E2 or less.

After the present inventors' detailed examination, it was found that the following structures satisfy the requirements for the construction in which the above processes (1) and (2) are performed.

The escape depth of secondary electrons $\lambda$ is made to disperse and increase depthwise by constructing the surface of the spacer in such a manner that the incident angle of primary electrons have a distribution in the direction of film thickness. Because of $\lambda \cdot d$ in many regions within a solid from the difference between the energies of electrons, the increasing rate of d with the dispersion of incident angle in the surface position is infinitesimal compared with the increasing rate of $\lambda$, as a result, $d/\lambda$ value becomes small and incident angle multiplication coefficient of secondary electron emission coefficient $m_0$ is reduced. The above method in which incident angle is allowed to have a distribution in the direction of film thickness on the surface of the spacer is implemented by giving the surface of the spacer a network structure in which multiple localized parts are depressed and arranged in an intricate manner.

After the present inventors' detailed examination, it was found that the concrete example of such an intricate structure is not necessarily limited to the construction of the spacer having an uneven surface. Even if the top surface of the spacer is smooth, it is possible to produce a construction in which incident angle dependency coefficient is small.

Increase in λ was attempted with these methods, and it is found that the application of a suitable design allows incident angle multiplication coefficient of secondary electron emission coefficient $m_0$ to be reduced to about one third or smaller as compared to the conventional ones, that is, to be reduced to about 3.

In the present patent application, the measurement of secondary electron emission coefficient and the determination of incident angle multiplication coefficient of secondary electron emission coefficient $m_0$ are carried out as described below.

First, for the measurement of secondary electron emission coefficient, a general-purpose scanning electron microscope (SEM) equipped with an electronic ammeter is used. For the measurement of primary electron current, Faraday cup is used. The amount of secondary electron current is defined using a detector with collectors (for example, MCP is available). Alternatively, it may be obtained from data current and primary electron current using the relationships of the principle of continuity of data current passing through data portion, primary current and secondary current. Incident angle multiplication coefficient of secondary electron emission coefficient $m_0$ can be obtained by conducting the measurement at an incident angle of 0 and at an incident angle of other than 0 under the same incident energy conditions. It is particularly good way to define $m_0$ to plot the values of secondary electron emission coefficient δθ measured at different incident angles as a θ−δ property and perform regression analysis (fitting) in general formula (1) by the least square method. In this patent application, the above fitting was performed using the secondary element emission coefficients measured at an incident angle of 0, 20, 40, 60 and 80 degrees. As a spot diameter, the size was employed which makes it possible to simultaneously expose the first and second regions to electrons. The measurement was conducted at a vacuum of $10^{-7}$ Torr ($1.3\times10^{-5}$ Pa) or lower at room temperature (20° C.).

<Materials for Multiple Penetration Depth Network System Typified by $RuO_2$>

The process of reducing incident angle dependency of secondary electron emission using the network structure consisting of an intricate surface described above is understood as follows.

Both of the primary and secondary electrons traveling in the highly resistive film portion gradually lose their energy while interacting with the atoms within the medium and repeating collision and scattering. In such a situation, their penetration depth and energy decreasing rate largely depend on the electron density of the medium they pass through. In the medium having a high electron density, since the probability of their scattering is high, their penetration depth becomes small. In addition, since the energy decreasing rate for a certain penetration distance is large, the amount of secondary electrons generated for unit depth increases. Thus, in the structure having a high electron density, in other words, in the material having a large specific gravity, penetration depth of electrons is smaller and the amount of secondary electrons generated within the medium is larger than those in the material having a small specific gravity.

When taking into account the behavior of the secondary electrons generated at the interface of the media different in electron density while taking into account the differences in penetration depth and generation amount, it is considered microscopically that a phenomenon occurs that secondary electrons are emitted from the region where electron density is high into the region where electron density is low.

In cases where the above interface is formed unevenly and consequently the surface area is increased, electrons traveling in the low electron density region where penetration depth of incident electrons is large reach again its interface with the high electron density region, thus they lose their energy. Charges remain in the film for a certain period of time in the dielectric polarization, they, however, recombine with positive holes and vanish within the film in the end. After all, most of these electrons are not emitted into vacuum, and the amount of secondary electron emission is decreased.

In the embodiment of the present invention, the mixture of two different types of materials is used for the above two regions both of which are different in electron density and constitute the above intricate interface. The suitably intricate interface is formed especially by allowing the second region, which is made up of the second material, to constitute a network in the first region, which is made up of the first material.

Table 1 shows the processes implemented by the embodiment of the present invention in an arranged manner.

TABLE 1

| | International Network System $RuO_2$ Thick Film Paste | |
|---|---|---|
| Interface (Example) | Glass Component | $RuO_2$ |
| Specific Gravity ρ | Small | Large |
| Electron Density $\rho A_{eff}/Z_{eff}$ | | |
| Primary Electron Penetration Depth | Large | Small |
| Secondary Electron Escape Depth λ | Large | Small |
| Amount of Secondary Electron Generated dE/dx/ξ | Small | Large |

This structure is allowed to have a function of controlling secondary electrons by dealing with the two regions, each of which has a different penetration depth due to the difference in electron density, as an interface, and if the structure is constructed in such a manner that an interface of the two regions different in electron density distributes in the film, it can realize the same effects without limiting the material to the above one.

The invention of an electron beam apparatus according to the present application is constructed as follows.

An electron beam apparatus comprising a hermetic container provided with an electron source, characterized in that the above hermetic container comprises a first member, at least part of the above first member being coated with a film, the above film comprising a first region and a second region different from the above first region in electron density, the above second region forming a network in the above first region.

This construction makes it possible to control the effects of the first member being electrically charged. The first member is provided within the hermetic container in this construction, and regardless of its position within the container, the present invention is effective since electrons are likely to fly and reach various positions within the hermetic container. The present invention, however, is particularly effective when the construction is such that the first member exists close to the orbit of the electron output from the electron source. For example, in cases where the first member exists between the electron source and the targeted region of the electrons output from the above electron source in the hermetic container.

In the above invention, preferably the electron density of the above second region is greater than that of the above first region. In particular, it is preferable that the electron density of the above second region is one and a half or more times as great as that of the above first region.

Preferably, the above second region is made up of a conductive material. The film is suitably allowed to be conductive if the second region constituting the network is conductive.

In each of the above inventions, preferably the above first region contains a glass component.

In each of the above inventions, preferably the above second region contains at least one component selected from the group consisting of ruthenium oxide, Pd—Ag, carbon, molybdenum oxide, LaB-tin oxide, tantalum oxide, $MoSi_2$, $NbSi_2$, $TaSi_2$ and $M_2Ru_2O_{7-x}$, wherein M is any one of Bi, Pb and Al.

In each of the above inventions, preferably the above first region contains a glass component containing at least one selected from the group of silicon oxide, sulfur oxide, boron oxide and alumina.

In each of the above inventions, the above film can be obtained by heating the mixture containing the first material for constituting the first region and the second material for constituting the second region, in particular, by heating the mixture containing the first material for constituting the first region and the second material for constituting the second region at a temperature equal to or above the softening point of the above first material, or by heating the mixture containing the first material for constituting the first region and the second material for constituting the second region at a temperature equal to or above 600° C.

In each of the above inventions, preferably the above film consists of the mixture containing the first material for constituting the first region and the second material for constituting the second region in the weight ratio of 10:1 to 1:1.

The above first member can be made of non-alkali glass or low-alkali glass with the above film formed on it, or can be made of a ceramic material with the above film formed on it.

Preferably the above ceramic material contains alumina and zirconia. Further, preferably the proportion of zirconia to the above ceramic material is 30 to 90 wt %. Further preferably the main component of the above ceramic material is alumina.

In each of the above inventions, preferably the above film has a sheet resistivity of $10^7$ [Ω/□] to $10^{14}$ [Ω/□].

In each of the above inventions, preferably the above film, when being formed on a smooth substrate so as to have a smooth surface, has a composition which provides secondary electron emission coefficient of 3.5 or less under vertical incident conditions.

In each of the above inventions, preferably the surface of the above film has a high oxygen concentration as compared with the inside thereof.

In each of the above inventions, the above film can be formed suitably by any one of the following methods: sputtering, vacuum deposition, wet printing, spraying, or dipping.

In each of the above inventions, it is preferable that the above first member abuts the above electron source, that the above first member has a first film, which is the aforementioned film, and a highly conductive film provided on the portion where the above first film and the above electron source abut with each other, and that the above first film and the above highly conductive film are in contact with each other.

In each of the above inventions, it is preferable that the above first member abuts the electrode provided within the above hermetic container to control the electrons emitted from the above electron source, that the above first member has a first film, which is the aforementioned film, and a highly conductive film provided on the portion where the above first film and the above electrode abut with each other, and that the above first film and the above highly conductive film are in contact with each other.

Preferably the above highly conductive film has a low sheet resistivity as compared with the above first film. In particular, the above highly conductive film has a sheet resistivity lower than the above first film by an order of magnitude. In cases where the highly conductive film and the first film are in contact with each other, even if nonuniform charges exist in the first film, the highly conductive film makes it possible to relax nonuniform charges. In the construction where the first member and the electron source or the electrode abut with each other, when the construction contains a highly conductive film at the portion where the above two abut with each other, a first configuration may be employed where a substrate 1, a first film 2 and a highly conductive film 3 are arranged in this order so that the highly conductive film can directly touch the electron source or the electrode, as shown in FIGS. 1A to 1C, or a second configuration may be employed where the substrate 1, the highly conductive film 3 and the first film 2 are arranged in this order so that the first film 2 directly abuts the electron source or the electrode. In the first configuration, the first film is electrically connected to the electron source or the electrode via the highly conductive film, and in the second configuration, since the first film has a lower resistance in the direction of the film thickness at the portion where the first film and the electron source or the electrode abut with each other, the charges generated at some portion of the first film can move to the electron source or the electrode via the highly conductive film and the first film at the portion where the first film and the electron source or the electrode abut with each other. In other words, the first film is electrically connected to the electron source or the electrode via the highly conductive film.

Each of the above inventions is effective in its application to the first member wanting to relax the effects due to electrification, and it is especially effective when the first member is a spacer.

Each of the above inventions can be constructed in such a manner that it further comprises an electrode for controlling the electrons emitted from the above electron source within the above hermetic container. In particular, the above electrode, for example, may be an accelerating electrode which provides voltage to accelerate the electrons emitted from the electron source toward a target. Each of the above inventions is particularly effective in a construction where the voltage applied between the electron emission device contained in the above electron source and the above electrode is 3 kV or higher.

In the above construction comprising such an electrode, it is suitable that the film of the above first member is electrically connected to both of the above electron source and the above electrode. The electrical connection between the film and the electron source is implemented by allowing the film to electrically connect to the electrode, such as wiring, contained in the electron source.

In each of the above inventions, it is suitable that the above electron source has a cold cathode element as an electron emission device. As a cold cathode element, suitably used is a surface conduction type electron emission device. In each of the above inventions, particularly effective is the use of the electron emission device contained in the electron source which generates an electric field having a field element in the direction parallel to the main surface of the electron source when emitting electrons.

In each of the above inventions, preferably the above target is such one as produces images when being exposed to electrons. The one provided with a fluorescent substance is suitably employed for the above target.

In each of the above inventions, multiple rows of emission elements and multiple columns of electron emission devices are wired in a matrix can be suitably employed as an electron source. The electron source can be constructed in a simple matrix.

Alternatively, a construction can be also employed in which a control electrode for modulation is provided besides the electron emission mechanism.

For example, a ladder electron source may be used in which multiple rows of wiring formed by connecting multiple electron emission devices (suitably cold cathode elements) in a row to each other at each of their ends are arranged, and the electrons emitted from the above electron emission devices are controlled by a control electrode (also called grid) arranged over the above electron emission devices along the direction intersecting the wiring.

The invention of the above first member itself is within the scope of the present patent application.

One of the invented methods of producing a member for use in an electron beam apparatus according to the present application is constructed as described below.

A method of producing a member for use in an electron beam apparatus comprising a hermetic container with an electron source in it to be arranged in the above hermetic container comprising the steps of: arranging the mixture of a first and a second materials on a substrate and heating the mixture at a temperature equal to or higher than the softening point of the above first material, characterized in that the above second material enters the pores in the region consisting of the above first material during the above heating process.

Further, another one of the invented methods of producing a member for use in an electron beam apparatus according to the present application is constructed as described below.

A method of producing a member for use in an electron beam apparatus comprising a hermetic container with an electron source in it to be arranged in the above hermetic container comprising the steps of: arranging the mixture of a first and a second materials on a substrate and heating the mixture at a temperature equal to or higher than 600° C., characterized in that the above second material enters the pores in the region consisting of the above first material during the above heating process.

In the invention of each of the above production methods, it is particularly suitable that the above first material contains a glass component, and it is preferable that the above substrate has a softening point higher than that of the above glass component.

According to the concept of the present invention, the present invention is applicable not only to an image producer suitable for displaying, but to a light emission source for the alternative to the light emitting diode etc. of an optical printer consisting of a photosensitive drum, light emitting diodes, etc. And the above image producer is applicable not only to a linear light emission source, but to a two-dimensional light emission source if the above m rows of wiring and n columns of wiring are properly selected. In this case, the image producing member is not limited to the substances directly emitting light, such as fluorescent substances used in the embodiments described below, but the member is also applicable on which a latent image is formed due to the charge by electrons. Further, according to the concept of the present invention, the present invention is applicable to the cases where the member exposed to the electrons from the electron source is other than image producing member such as fluorescent substances, for example, as is the case of electron microscopes. The present invention may be constituted of a general electron beam apparatus which does not specify a member exposed to the electrons.

BRIEF DESCRIPTION OF THE DRAWINGS

FIG. 1A is a cross-sectional view of one form of a spacer substrate embodying the present invention, and FIGS. 1B and 1C are views illustrating a network structure of a mixture on a spacer substrate embodying the present invention;

FIG. 2A is a general view of a columnar spacer which is another form of the present invention. FIG. 2B is a vertical-sectional view of the columnar spacer of the present invention;

FIG. 3A is a general view of an angle spacer which is still another form of the present invention. FIG. 3B is a horizontal-sectional view of the angle spacer of the present invention;

FIG. 7 is a graph illustrating incident angle θ dependency of secondary electron emission coefficient;

DETAILED DESCRIPTION OF THE PREFERRED EMBODIMENTS

The preferred embodiments of the present invention will be described below.

The spacer described below comprises a spacer substrate and a highly resistive film coating at least part of the above spacer substrate. The above highly resistive film is a mixture containing a glass component as a first component and an electrically conductive component as a second component, and the first and the second components form a three-dimensional network structure within the highly resistive film.

The first component consists of a glass component containing at least one selected from the group of silicon oxide, sulfur oxide, boron oxide and alumina, and the second component consists of an electrically conductive component containing at least one selected from the group of ruthenium oxide, Pd—Ag, carbon, molybdenum oxide, LaB-tin oxide, tantalum oxide, $MoSi_2$, $NbSi_2$, $TaSi_2$, $M_2Ru_2O_{7-x}$ (M represents any one of Bi, Pb and Al).

Figure 1A:
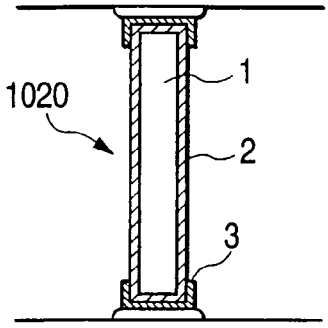
FIGS. 1A, 1B and 1C are schematic presentations of a spacer in accordance with one embodiment of the present invention.
Figure 1B:
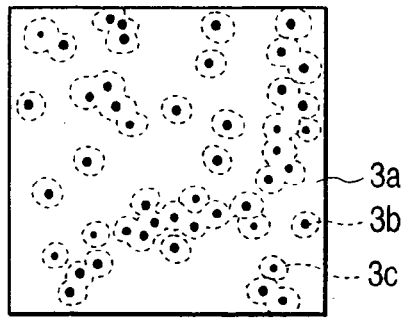
Figure 1C:
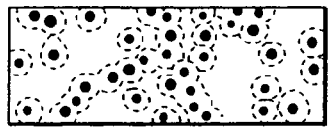

Referring now to the drawings, FIG. 1A is a schematic sectional view of a spacer with a highly resistive film coated on it embodying the present invention, and FIG. 1B a schematic view showing a network structure of the above highly resistive film. In the figure, reference numeral 1 designates a spacer substrate, numeral 2 a highly resistive film formed on the surface of the spacer substrate 1 for preventing the surface from being charged. The highly resistive film 2 forms a three-dimensional network in such a manner that the component 1 consisting of a glass component and the component 2 consisting of an electrically conductive component intertwine with each other. The interface of the components 1 and 2 distributes in the direction of the film thickness, and the normal direction of the interface can be considered to distribute in all the direction. Reference numeral 3 designates a low resistive film for obtaining an ohmic contact between the electrode and the spacer which is provided in case of necessity.

Hereafter is described an embodiment of a planar image display (electron beam apparatus) using the substrate coated with a highly resistive film described above as a spacer. As roughly shown in FIG. 8 (the details will be described below), the image display is characterized in that it has a structure in which a substrate 1011 with multiple cold cathode elements 1012 formed on it and a face plate 1017 with a clear fluorescent film 1018 as a light emitting material formed on it are arranged opposite to each other via a spacer 1020, and that the spacer 1020 is coated with a highly resistive film consisting of a glass component and an electrically conductive component and forming a three-dimensional network structure to prevent the surface of the spacer from being charged.

[Functions of Network (Incident Angle Dependency of Static Charges Due to Secondary Electron Emission)]

Figure 2A:
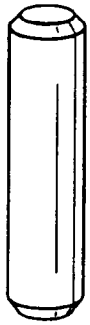
FIGS. 2A and 2B are illustrations of another form of a spacer embodying the present invention.
Figure 2B:
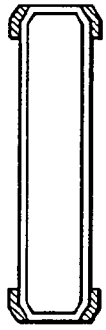

Referring to the drawings, there are shown in FIGS. 2A, 2B and 3 the other structures of the spacer coated with a highly resistive film in accordance with the present invention. Due to the functions performed by the interface of the two components existing within the highly resistive film on the spacer of the present invention, the highly resistive film has multiple effects, as described below, on the multiple problems having been described as a problem to be solved.

First, the highly resistive film in accordance with the present invention is effective in decreasing the amount of the static charge caused by the incident electrons in a high incident angle mode, which accounts for the most part of the electrical charge on the surface of the spacer. Due to the effect of its network structure, the result is obtained that incident angle multiplication coefficient of secondary electron emission coefficient $m_0$ defined in the general formula (1) is decreased. In particular, $m_0$ is restricted to a level of one third or less as high as that of the conventional uniform films consisting of inorganic oxides, nitrides and so on. This is particularly effective against the incident electrons directly from the electron emission device closest to the spacer whose incident angle is 80 degrees or higher.

Second, the highly resistive film in accordance with the present invention is effective in shutting secondary electrons in the film, like an integration of fine Faraday cups, and hence, in restricting the absolute value of $\delta$.

Third, the highly resistive film in accordance with the present invention is effective in restricting multiple emission of secondary electrons. The secondary electrons having been emitted have orbital motion toward the anode while being accelerated by the energy received from an accelerating field. However, the energy is relatively small immediately after the emission, and the above electrons are pulled into the locally charged region and rush to the surface of the spacer again. This causes ($\delta-1$)-fold positive charge to be generated. In such a situation, in the highly resistive film in accordance with the present invention, the re-rush of the electrons is performed within a fine network, unlike the conventional films of inorganic oxides, nitrides and so on, and the conditions under which the electrons re-enter the spacer are such that the relation $\delta-1 \leqq 0$ or $\delta-1>0$ is satisfied but the absolute value of $|\delta-1|$ does not become very large, restricting the accumulation of positive charges.

Fourth, the highly resistive film in accordance with the present invention is effective in restricting the incident angle of the electrons reflected from the anode.

The flying route of the incident electrons into the spacer has various distributions. In cases where the electrons reflected from the face plate re-enter the spacer (hereinafter referred to as FP reflected electrons), the emission direction has a distribution almost in the form of a concentric circle, accordingly the reflected electrons have a distribution in many directions in the circumstances.

After the present inventors' intensive examination of the spacer-element distance dependency and anode voltage dependency of the static charge of each spacer, it has been found that the orbit distribution of FP reflected electrons observed from the high voltage application electrode side in the above situation includes not only the orbit distribution of the reflected electrons from the anode substrate (a metal back or anode electrode provided to a face plate) from the closest electron element (the first closest), but that of the emitted electrons from the second, third and fourth closest electron elements.

The effects of the above flying distance vary depending on the image display because each image display is differently modulated. The effects are, however, doubled by the installation of the members, such as an aluminium electrode which is provided to promote efficiency in utilizing the light emitted from fluorescent substances, and the increase in accelerating voltage applied, generally for the purpose of obtaining a high luminance. This is one of the causes for the static charge on the spacer. The above phenomenon means that FP reflected electrons are dependent on the distance of the electron reflecting position of the face plate from the spacer and that the amount of the re-incident electrons is larger at the element closer to the spacer. In addition, the phenomenon means that, among the FP reflected electrons, the one reflected in the position closer to the spacer has its incident angle more doubled when re-entering the point far away from the light emitting position. For these reasons, the network structure formed almost uniformly and randomly within the film effectively functions on the entire incident directions as a secondary electron emission controlling effect on the reflected electrons in an angled mode.

The present invention aims at implementing a construction for controlling electrification using two components. As for thick film resistors for controlling resistance by adjusting the mixing ratio of two components, there are descriptions, for example, Lectures on Fundamentals of Electronics Packaging Technology, Vol. 3, Film Circuit Forming Technique, pp. 62-76, and "Factors Affecting Resistance of $RuO_2$ Thick Film Resistor and TCR," Proceedings of the Electricity Society of Japan A (Vol. 108, No. 8, 1988): pp. 329-334, and they are known in the field of IC.

However, after the present inventors' extensive examination, it was found that the secondary electron emission coefficient of the mixture of the above two components is smaller than the value predicted based on their compositions and this fits even its absolute value. Further it was found that the mixture is characterized by a very small incident angle dependency coefficient which is a suitable property for the surface of the structural member used in an electron emission apparatus. The detailed factors of the effects are not clear yet, however it is considered that these effects are due to the intricate structure of the mixture and the difference between the two components in physical property.

Specifically, in the construction described with reference to the embodiments below, used as a first component is the glass material (typically an insulating material or a highly resistive material which is slow to relax positive charges effectively injected as a result of secondary electron emission) such that the absolute value of its secondary electron emission coefficient and its specific gravity are small as compared with those of the electrically conductive component used as a second component. For example, for $52PbO\text{-}35SiO_2\text{-}10Bi_2O_3\text{-}3Al_2O_3$ used as a glass material for ruthenium oxide paste, the specific gravity of the glass component is about 3.7 g/cm$^3$ while that of ruthenium oxide, as an electrically conductive component, is 7.1 g/cm$^3$. Incident angle multiplication coefficient of secondary electron emission coefficient $m_0$ is proportional to the penetration depth of primary electrons while the penetration depth is inverse proportion to electron density of a solid, as described in the paragraph referring to the subject of the present invention. Accordingly, a solid with a smaller specific gravity has a larger penetration depth, and hence a larger incident angle dependency coefficient. As for the second component, although the materials having an excellent conductivity as well as a function to accelerate local relaxation of charges are used, they generally have a higher secondary electron emission coefficient. However, the specific gravity of ruthenium oxide, which is one example of the conductive materials used in the present invention, is large as compared with that of the glass components. Accordingly, the penetration depth of primary electrons becomes smaller and incident angle multiplication coefficient of secondary electron emission coefficient $m_0$ becomes smaller as well.

The relationship of [electrically conductive components having a larger secondary electron emission coefficient, as typified by ruthenium oxide] to [glass components having a smaller secondary electron emission coefficient] may be considered effectively as that of [bulk] to [outside], in terms of secondary electron emission, since the above two components have an interface as a result of their phase-splitting. In other words, the interface of the two components is considered to be a surface. As for the electrically conductive component of the present invention, since it forms an intricate three-dimensional network structure within a solid, it has almost the same effects as a porous film which provides a large surface area within a solid. As a result, multiple effective surfaces are allowed to exist under the macroscopically defined surface of the highly resistive film consisting of the two components in a distributed manner, and incident angle dependency of secondary electron emission macroscopically defined becomes small. Thus the incident angle multiplication effect of the film as a whole is restricted, and the surface is obtained whose incident angle multiplication coefficient of secondary electron emission coefficient $m_0$ represented by the general formula (1) below is 10 or less. Further, the surface may have an incident angle multiplication coefficient of secondary electron emission coefficient $m_0$ of 5 or less, which is more preferable electrification-restricting conditions.

General Formula (1)

$$\frac{\delta_\theta}{\delta_0} = \frac{\exp(-m_0\cos\theta)^{1-\left\{1-\frac{m_0\cos\theta}{1+(m_1)^{-1}\times(m_0\cos\theta)^{m_2}}\right\}}}{\exp(-m_0)^{1-\left\{1-\frac{m_0}{1+(m_1)^{-1}\times m_0^{m_2}}\right\}}} \times \frac{1}{\cos\theta}$$

wherein parameters $m_1$ and $m_2$ are constants of $m_1=0.68273$, $m_2=0.86212$, and δθ and δ0 are secondary electron emission coefficients for primary electrons whose incident angle are θ and 0 degrees, respectively.

Another characteristics of porous films are considered to be a current capture effect which works as if there exist multiple Faraday cups to restrict the absolute value of the secondary electron emission coefficient.

What have been described above are the main functions of the mixture films of the embodiments of the present invention that is, the network structure consisting of a glass component and a conductive component.

[Means for Forming Film]

In the embodiments of the present invention, the above mixture films are obtained by subjecting the paste consisting of the two components, a glass frit component and an electrically conductive component, to a coating and a heat drying processes. The film formation by means of a wet production process is advantageous in that it makes possible lowering costs because it is highly efficient in using raw materials, reduces tact time, requires no vacuum fixing and so on.

A combination of a coating process and a heat drying process is referred to as a wet production process.

[Compositional Conditions and Firing Conditions]

Basically, various types of antistatic films can be used in the present invention as long as two components different from each other in specific gravity or electron density, such as a glass component and an electrically conductive component, form a three-dimensional network structure. However, preferably the material's mixing ratio is such that the weight ratio of one component to the other {for example, (glass component):(conductive component)} is from 10:1 to 1:1 in terms of assurance of a larger area at the interface of the above network structure. In order to avoid temperature dependency coefficient of specific resistance described below becoming significantly negative, preferably the above weight ratio is 1/4 or larger.

Further, in order to enlarge the effective surface area, the heating temperature equal to or higher than the softening point of the glass component is adopted so that the conductive component can enter the pores of the glass component.

[Spacer Substrate]

In order for the spacer substrate to obtain a heat resistance higher than the softening point of the glass component contained in the highly resistive film paste, preferably ceramic such as alumina, glass or non-alkali glass or low-alkali glass are used for the substrate material. Further, in order to prevent the image producer from fracturing during the heating process of its assembly due to the difference between the face plate or the rear plate and the spacer in thermal expansion coefficient, a material for adjusting thermal expansion coefficient can be added to the substrate material.

In cases where alumina substrate is used as a spacer substrate, the materials for adjusting thermal expansion coefficient include zirconia (zirconium oxide) etc. For example, when spacers each having a spacer substrate consisting of alumina are assembled into a face plate consisting of blue plate glass whose thermal expansion coefficient is from $80\times10^{-7}/°$ C. to $90\times10^{-7}/°$ C., if the mixing ratio by weight of alumina to zirconia is from 70:30 to 10:90, the thermal expansion coefficient of the spacer substrate is allowed to be from $75\times10^{-7}/°$ C. to $95\times10^{-7}/°$ C. The mixing ratio by weight of alumina to zirconia is suitably from 50:50 to 20:80. As a material for adjusting thermal expansion coefficient, the materials other than zirconia, such as lanthanum oxide ($La_2O_3$), are also applicable.

[Resistance Value of Highly Resistive Film (δ of Highly Resistive Film, Construction of Highly Resistive Film)]

As a method of forming (coating) a highly resistive film, the existing processes for forming an antistatic film are applicable. For example, wet printing process, aerosol process, dipping process and so on are applicable. Liquid phase processes such as dipping process, which are simple and easy, are preferable in terms of lowering costs of production process.

Further, in highly resistive films, it is preferable that the secondary electron emission coefficient is low. In smooth films, it is more preferable that the peak of the secondary electron emission coefficient is 3.5 or lower. In other words, it is preferable that the secondary electron emission coefficient is 3.5 or lower when measuring it under vertical incident conditions of electrons with respect to a smooth film surface formed on the smooth substrate. Further, it is preferable in terms of chemical stability of the film that the surface layer of the highly resistive film is in a highly oxidized state as compared with the inside of the film.

In the image display of the present invention, one side of the above spacer 1020 is electrically connected to the wiring on the substrate 1011 on which cold cathode elements are formed. And the opposite side of the same is electrically connected to the accelerating electrode (metal back 1019) for causing the electrons emitted from the cold cathode elements to collide with the light emitting material (fluorescent film 1018) with a high energy. Specifically, a current whose amount is equivalent to the amount of accelerating voltage divided by the resistance value of the antistatic film flows through the antistatic film formed on the spacer.

Thus, the resistance value Rs of the spacer is set for a value within the range desirable in terms of its antistatic effect and power consumption. In terms of the antistatic effect, preferably the sheet resistivity R/□ is $10^{14}$ Ω/□ or lower. In order to obtain a sufficient antistatic effect, it is more preferable that the sheet resistivity R/□ is $10^{13}$ Ω/□ or lower. Although the lower limit of the sheet resistivity is dependent on the shape of the spacer and the voltage applied between the spacers, preferably it is $10^7$ Ω/□ or higher.

As for the thickness of the highly resistive film t, preferably its lower limit is 0.1 μm or larger taking into consideration the penetration depth of primary electrons and the growth depth of the network structure, and preferably its upper limit is 10 μm or smaller taking into consideration the peeling due to its membrane stress and the like.

Considering that the sheet resistivity R/□ is ρ/t and that preferable ranges of R/□ and t are as described above, preferably the specific resistance ρ of the antistatic films is from $10^2$ to $10^{11}$ Ωcm. In order to realize more preferable ranges of sheet resistivity and film thickness, desirably ρ is from $10^5$ to $10^9$ Ωcm.

As described above, the temperature of the spacer rises when current flows through the antistatic film formed thereon or when the entire display generates heat during its operation. If the antistatic film has a temperature coefficient of resistance which is significantly negative, its resistance value decreases with temperature increase, which leads to increase in the current flowing through the spacer, and hence increase in temperature. And the current continues to rise till the power source reaches its limits. Empirically, the values of temperature coefficient of resistance at which such a thermal runaway takes place are negative and their absolute values are 1% or larger. In other words, it is preferable that the temperature coefficient of resistance of the antistatic film is less than −1%.

In the antistatic film of the spacer according to the present invention, its resistance can be controlled by controlling its component ratio, in addition, the temperature dependency of its resistance value can be controlled using addition materials. This is advantageous because the control can be performed without changing the network structure of the film. The excellent addition materials are metal oxides. Among the metal oxides, oxides of transition metals such as chromium, nickel and copper are particularly preferable The antistatic films of the present invention have been described in terms of preventing static electricity of the spacers of a planar image display, their applications are, however, not limited to this, they can be used as an antistatic film in a different way.

The spacer provided with the above highly resistive film is characterized in that it has a low resistive film on the portion in contact with the upper and lower substrates, which makes possible the restriction of the local accumulation of charges in the vicinity of the spacer-anode/cathode junctions. Preferably the resistance value of the low resistive film is 1/10 times or less as high as that of the above highly resistive film and $10^7$ [Ω/□] or lower by sheet resistivity in order to obtain its satisfactory electrical connection with the upper and lower substrates. In terms of obtaining an element having a simpler structure as well as a high luminance, more preferably the above electron emission device is a cold cathode element. More preferably the above electron emission device includes an electrically conductive film comprising an electron emission portion between its electrodes. And more preferably the above electron emission device is a surface conduction type electron emission device.

The electron beam apparatus to which the art of the present invention is applied can be also used as an image producer for producing an image by exposing the aforementioned target to the electrons emitted from the above electron emission device in response to input signals. In terms of image recording, there are various materials applicable to the above target which make possible the formation of a latent image, however the target consisting of fluorescent substances allows to record and display dynamic images at lower cost.

[Rough Summary of Image Display]

The construction of display panels of image displays to which the present invention is applied and the method of producing such panels will be described taking concrete examples.

Figure 8:
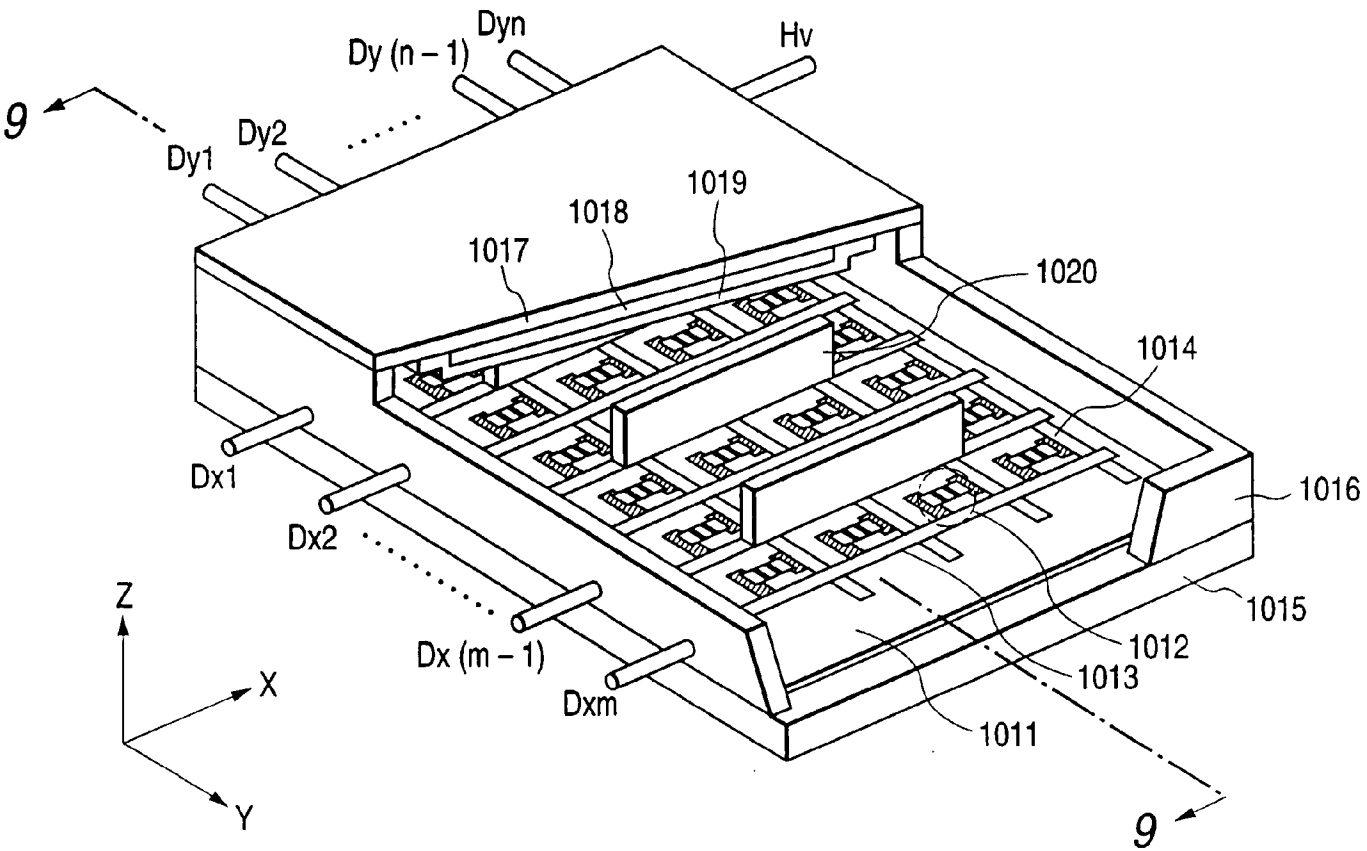
FIG. 8 is a partially cutaway view in perspective of a display panel of an image display embodying the present invention.

FIG. 8 is a perspective view, partially broken away, showing a display panel used in the embodiments with the internal structure being visualized.

In the figure, reference numeral 1015 designates a rear plate, numeral 1016 a side wall, numeral 1017 a face plate, and 1015 to 1017 form a hermetic container for maintaining the inside of the display panel vacuum. When assembling the hermetic container, the junctions of each member need to be sealed so as to maintain a sufficient strength and air tightness. And the sealing was achieved by, for example, coating the junctions with frit glass and firing them at 400 to 500° C. in the atmospheric air or in the nitrogen atmosphere for more than 10 minutes. The method of evacuating the hermetic container will be described below. Since the inside of the above hermetic container is maintained at vacuum of about $10^{-6}$ [Torr] ($1.33\times10^4$ Pa), spacers 1020 as an atmospheric-pressure resistant structure are provided so as to prevent the hermetic container from being fractured by atmospheric pressure or a sudden impact.

Then substrates of electron emission devices applicable to the image producer of the present invention will be described.

The substrate of an electron source for use in the image producer of the present invention is formed with multiple cold cathode elements arranged on it.

There are several ways of arranging cold cathode elements. For example, a ladder arrangement is such that cold cathode elements are arranged in a row and connected to each other at each of their ends through wiring (hereinafter referred to as "ladder arrangement electron source substrate"). And a simple matrix arrangement is such that each pair of element electrodes of cold cathode elements are connected to each other through the wiring in the X direction and wiring in the Y direction (hereinafter referred to as "matrix arrangement electron source substrate"). Image producers comprising a ladder arrangement electron source substrate need a control electrode (grid electrode) for controlling the flight of the electrons emitted from the electron emission devices On the rear plate 1015 is fixed a substrate 1011 on which N×M cold cathode elements 1012 are formed (wherein N, M are the positive integers of 2 or more and they are set properly according to the number of the pixel to be displayed. For example, in the image displays for high-definition televisions, desirably N is set for 3000 and M is set for 1000 or more). The above N×M cold cathode elements are wired in a simple matrix with M rows of wiring 1013 and N columns of wiring 1014. The portion consisting of the above 1011 to 1014 is called a multiple electron beam source.

For the multiple electron beam sources for use in the image display of the present invention, the material and shape of the cold cathode elements as well as the production method thereof are not restricted at all as long as they are wired in a simple matrix or arranged in a ladder form.

Accordingly, cold cathode elements, such as surface conduction type electron emission devices, FE type elements and MIM type elements, are applicable.

Now the structure of the multiple electron beam source will be described where surface conduction type electron emission devices (described below), as cold cathode elements, are arranged in a simple matrix wiring on the substrate.

Figure 10A:
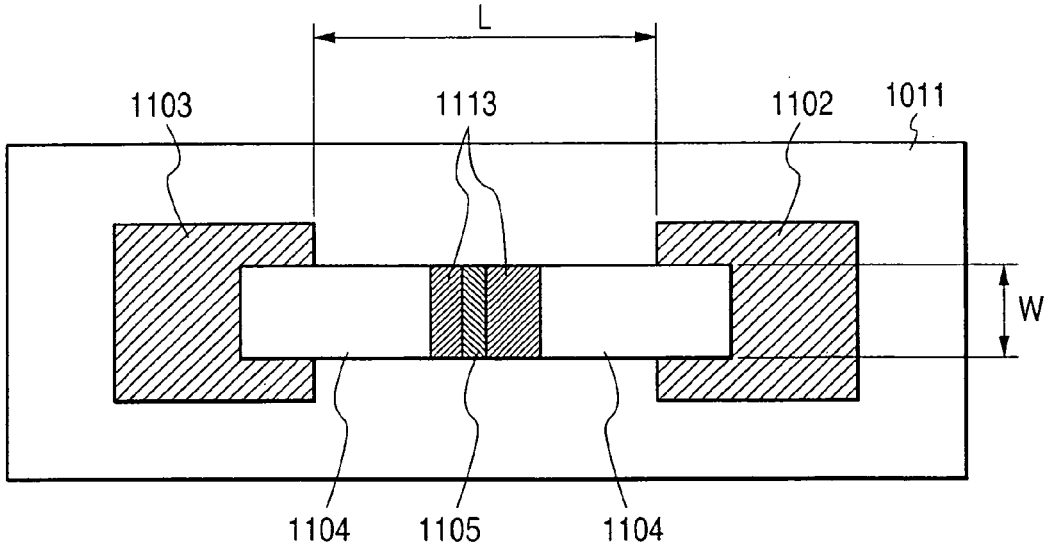
FIGS. 10A and 10B are plan views of the planar surface conduction type electron emission device used in an embodiment of the present invention.
Figure 10B:
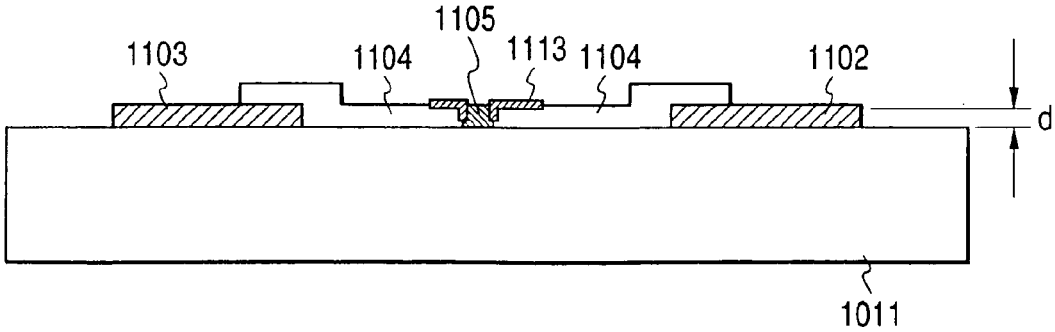
Figure 11:
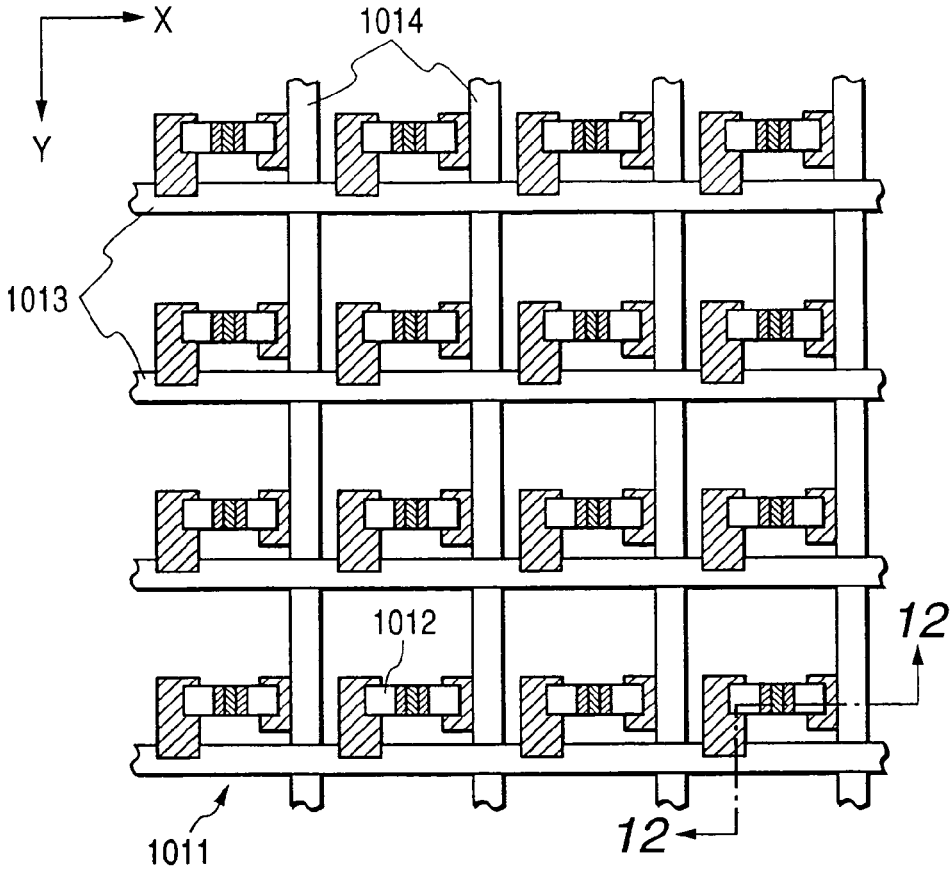
FIG. 11 is a plan view of the substrate of multiple electron beam sources used in one embodiment of the present invention.

Referring to the drawings, FIG. 11 shows a plan view of the multiple electron beam source used in the display panel of FIG. 8. On the substrate 1011, are arranged the same surface conduction type electron emission devices 1012 as shown in FIGS. 10A and 10B described below which are wired in a simple matrix arrangement with row wiring 1013 and column wiring 1014. On the portion where the row wiring 1013 and the column wiring 1014 intersect, an insulating layer (not shown in the figure) is formed between the electrodes so as to keep them electrically insulating.

Figure 12:
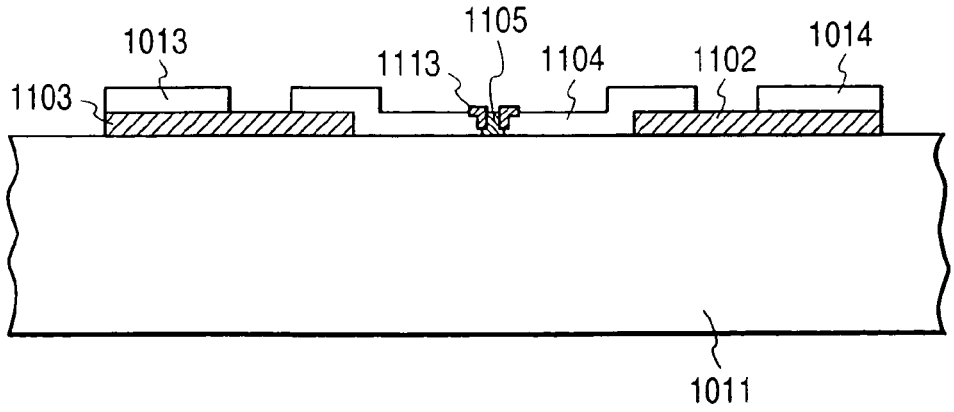
FIG. 12 is a sectional view of part of the substrate of multiple electron beam sources used in one embodiment of the present invention.

FIG. 12 is a cross sectional view of the multiple electron beam source of FIG. 11, taken along the line 12-12.

The multiple electron beam source having such a structure was produced in such a manner that, first, row wiring 1013, column wiring 1014, an insulating layer between electrodes (not shown in the figure), and an element electrode and conductive thin film of a surface conduction type electron emission devices 1012 were formed on a substrate, then energization forming processing (described below) and energization activation processing (described below) were conducted by feeding power to each element via row wiring 1013, column wiring 1014.

The present embodiment has been described taking for example the construction where the substrate of the multiple electron beam source 1011 is fixed on the rear plate 1015 of the hermetic container. However, the substrate of the multiple electron beam source 1011 itself may be used as a rear plate of the hermetic container as long as the substrate 1011 has a sufficient strength.

Figure 13A:
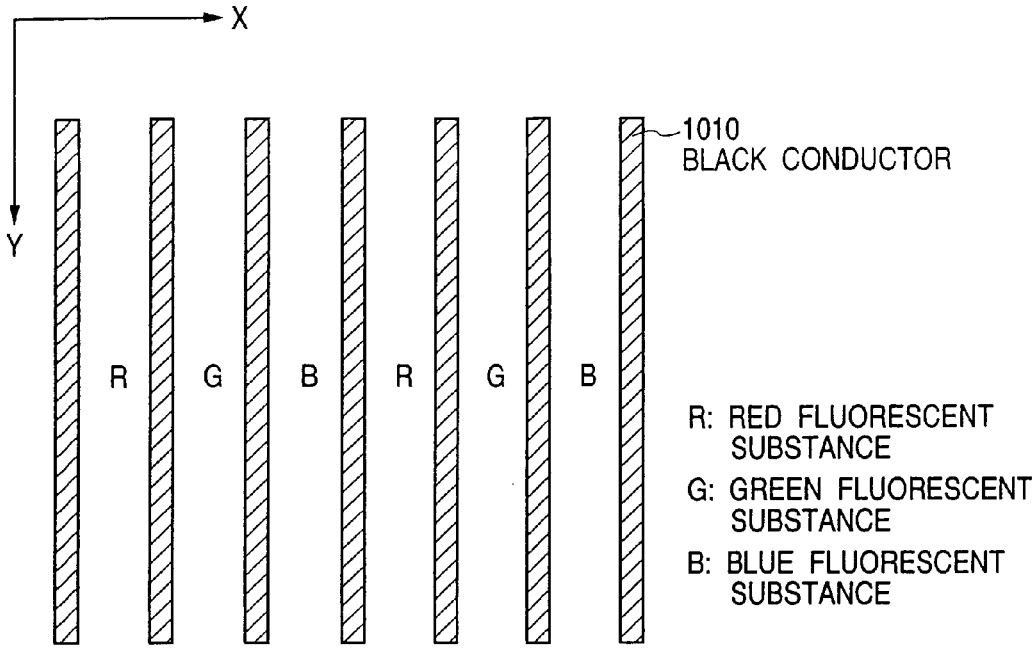
FIGS. 13A and 13B are plan views illustrating the arrangement of fluorescent substances on a face plate of a display panel.

On the rear side of the face plate 1017 is formed a fluorescent film 1018. Since the present embodiment is a color image display, the portion of the fluorescent film 1018 is coated with fluorescent substances of the three primary colors: red, green and blue, which are used in the art of CRT, in a certain pattern. The fluorescent substances of the three different colors are coated on the film, for example, in stripes as shown in FIG. 13A, and between the strips is provided a black conductor 1010. The purposes of providing the conductor 1010 are, for example, to prevent the occurrence of shear in display color when electron beams a little bit deviate from the right position, to prevent the reflection of external light so as not to decrease the display contrast, and to eliminate the charge-up of the fluorescent film resulting from the exposure to electron beams. Although graphite was used for the black conductor 1010 as a main component, the materials are not limited to this as long as they answer the above purposes.

Figure 13B:
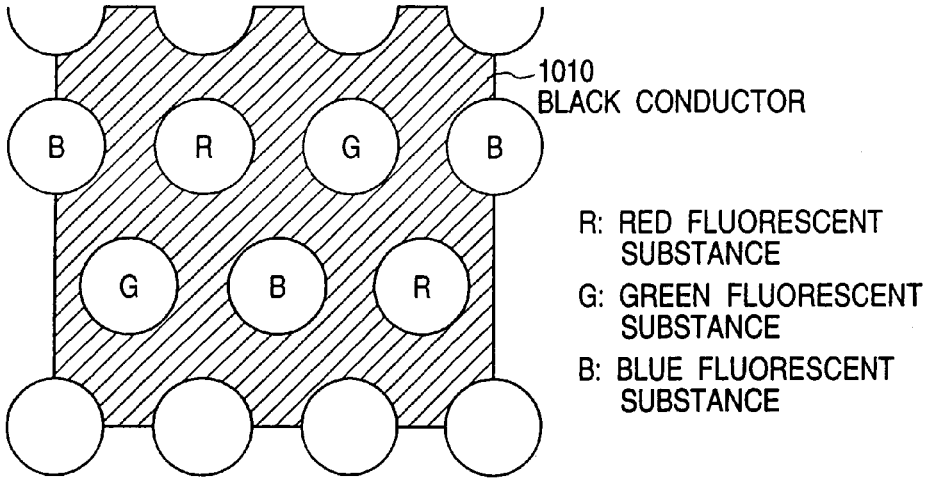

The coating patterns of the three primary colors are not limited to the stripes shown in FIG. 13A, either; a delta pattern and the other patterns (for example, the pattern shown in FIG. 14) are also applicable as shown in FIG. 13B.

When producing display panels in monochrome, the fluorescent substance of a single color is used for the fluorescent film 1018 and the black conductor 1010 is not necessarily used.

On one side, which is nearer to the rear plate, of the fluorescent film 1018 is provided a metal back 1019, which is well known in the art of CRT. The purposes of providing the metal back 1019 are, for example, to subject part of the light emitted by the fluorescent film 1018 to its mirror reflection and improve a light usage ratio, to protect the fluorescent film 1018 against the collision with negative ions, to utilize it as an electrode for applying an accelerating voltage to electron beams, and to utilize it as a conductive path for electrons emitted by the fluorescent film 1018 in an excited state. The metal back 1019 was formed in such a manner that, first, a fluorescent film 1018 was formed on the face plate substrate 1017, then the fluorescent film was subjected to smoothing processing, followed by vacuum deposition with Al. When a material for a low voltage is used for the fluorescent film 1018, the metal back 1019 is not necessarily used.

Although it was not used in the present embodiment, a transparent electrode made of, for example, ITO may be provided between the face plate substrate 1017 and the fluorescent film 1018 in order to apply an accelerating voltage and to improve the conductivity of the fluorescent film.

Figure 9:
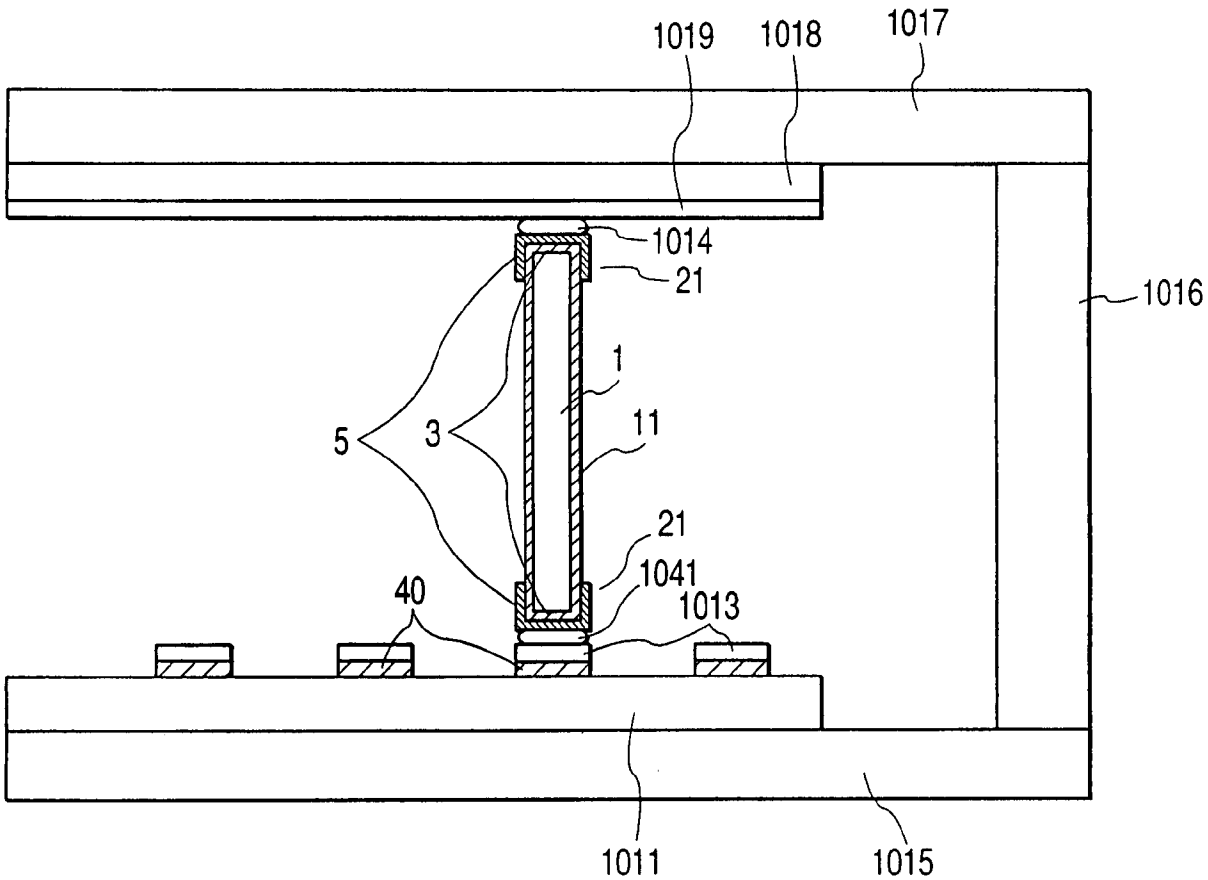
FIG. 9 is a sectional view of the display panel of FIG. 8 taken along the line 9-9.

FIG. 9 is a schematic sectional view of the display panel of FIG. 8, taken along the line 9-9, and reference numerals of each portion correspond to those of FIG. 8. The spacer 1020 consists of a member including an insulating member 1, a highly resistive film 11 formed on the surface of the above insulating member 1 to prevent static electricity, and a low resistive film 21 formed on touching portions 3 facing the inside of the face plate 1017 (metal back 1019 or the like) and the surface of the substrate 1011 (row wiring 1013 or column wiring 1014), respectively, as well as on the side surfaces 5 which is in contact with the above touching portions 3. The necessary number of the spacers are spaced and fixed to the inside of the face plate and the surface of the substrate 1011 via a jointing material 1041. The highly resistive film is formed on the surface of the insulating member 1 at least at the portion exposed to vacuum within the hermetic container, and it is electrically connected to both the inside of the face plate 1017 (metal back 1019 or the like) and the surface of the substrate 1011 (row wiring 1013 or column wiring 1014) via the low resistive film 21 on the spacer 1020 and the jointing material 1041. In the embodiments described here, the shape of the spacer 1020 is in a form of a thin plate, the spacer is arranged in parallel to the row wiring 1013 and is electrically connected thereto.

The spacer 1020 needs to have a sufficient insulating property to withstand a high voltage applied between the row wiring 1013/the column wiring 1014 on the substrate 1011 and the metal back 1019 inside of the face plate 1017. At the same time it needs to have a sufficient conductivity to prevent itself from being charged.

The insulating member 1 of the spacer 1020 includes ceramics member, such as quartz glass, glass with impurities such as Na and so on reduced in it, soda-lime glass, and alumina. Preferably the insulating member 1 is such that its thermal expansion coefficient is close to that of the member constituting the hermetic container and the substrate 1011.

The purpose of providing a low resistive film 21 to the spacer 1020 as a component thereof is to electrically connect the highly resistive film 11 with both of the face plate 1017 (metal back 1019 or the like) having a higher voltage and the substrate 1011 (wiring 1013, 1014 or the like) having a lower voltage. Thus, hereinafter it is sometimes referred to as an intermediate electrode layer (intermediate layer). The intermediate electrode layer (intermediate layer) can have multiple functions listed below.

(1) To Electrically Connect the Highly Resistive Film 11 to the Face Plate 1017 and the Substrate 1011

As described above, the highly resistive film 11 is provided to prevent the surface of the spacer 1020 from being charged. However, when the highly resistive film 11 is connected with both of the face plate 1017 (metal back 1019 or the like) and the substrate 1011 (wiring 1013, 1014 or the like) directly or via the jointing material 1041, a large contact resistance may be generated at the interface of their connection, which may make impossible the prompt elimination of the charges generated on the surface of the spacer 1020. In order to avoid this, the intermediate layer of low resistance is provided on the touching portion 3 of the spacer 1020 which is in contact with the face plate 1017, the substrate 1011 and the jointing material 1041, and the side surface 5 of the spacer 1020.

(2) To Allow the Voltage Distribution of the Highly Resistive Film 11 to Become Uniform The electrons emitted from a cold cathode element 1012 form an electron orbit in accordance with the voltage distribution formed between the face plate 1017 and the substrate 1011. In order to prevent the disorder of the electron orbit from taking place in the vicinity of the spacer 1020, it is necessary to control the voltage distribution of the highly resistive film 11 over the entire region. When the highly resistive film 11 is connected to the face plate 1017 (metal back 1019 or the like) and the substrate 1011 (wiring 1013, 1014 or the like) directly or via the jointing material 1041, non-uniformity occurs in the connecting state due to the generation of contact resistance at the interface of their connection. As a result, it is likely that the voltage distribution of the highly resistive film 11 will deviate from the desired value. In order to avoid this, the intermediate layer of low resistance is provided on the entire length of the end portion of the spacer (touching surface 3 or side surface 5)

where the spacer 1020 and both the face plate 1017 and the substrate 1011 abut with each other. The voltage of the highly resistive film 11 can be controlled over the entire region by applying the desired voltage to this intermediate layer.

(3) To Control the Orbit of the Emitted Electrons

The electrons emitted from a cold cathode element 1012 form an electron orbit in accordance with the voltage distribution formed between the face plate 1017 and the substrate 1011. For the electrons emitted from the cold cathode element 1012 in the vicinity of the spacer, restriction involved with the installation of the spacer 1020 (changes in wiring, element position etc.) may occur. In such a case, in order to produce an image free from distortion and non-uniformity, it is necessary to control the orbit of the emitted electrons so that the desired position on the face plate 1017 is exposed to the electrons. Providing a low resistive intermediate layer on the side surfaces 5 where the spacer and both of the face plate 1017 and the substrate 1011 abut with each other makes possible the realization of a desired property in the voltage distribution in the vicinity of the spacer 1020, which in turn enables the control of the orbit of the emitted electrons.

The low resistive film 21 can be selected from the films containing materials whose resistance value is lower than the materials of the highly resistive film 11 by an order of magnitude. The material of the low resistive film 21 is properly selected from the group consisting of metals such as Ni, Cr, Au, Mo, W, Pt, Ti, Al, Cu and Pd or their alloy, printed conductor consisting of metals such as Pd, Ag, Au, $RuO_2$, Pd—Ag or their oxides and glass etc., a transparent conductor such as $In_2O_3$—$SnO_2$, and semiconductor materials such as poly-silicon.

The jointing material 1041 needs to have conductivity so that the spacer 1020 can electrically connect to the row wiring 1013 and the metal back 1019. Specifically, frit glass to which a conductive adhesive material, metal particles and a conductive filler are added is suitable.

Referring to the drawings again, in FIG. 8, Dx1 to Dxm and Dy1 to Dyn and Hv designate terminals for electrical connection of a hermetic structure provided to electrically connect the display panel to electric circuits not shown in the figure. Dx1 to Dxm, Dy1 to Dyn and Hv electrically connect with the row wiring 1013 of the multiple electron beam source, the column wiring 1014 of the multiple electron beam source and the metal back 1019 of the face plate, respectively.

In order to evacuate the hermetic container, an exhaust tube and a vacuum pump, both of which are not shown in the figure, are connected to each other after the hermetic container is assembled. The hermetic container is evacuated to the vacuum degree of about $10^{-7}$ [Torr] ($1.33\times10^{-5}$ Pa). The exhaust tube is to be sealed after the evacuation, immediately before or after the sealing, however, a getter film (not shown in the figure) is formed in a prescribed position within the hermetic container to maintain the vacuum degree within the container. A getter film means a film formed by subjecting a getter material whose main component is Ba to heating with a heater or high-frequency heating and evaporation. Due to the adsorption of the above getter film, the vacuum degree inside the hermetic container is kept $1\times10^{-5}$ to $1\times10^{-7}$ [Torr] ($1.33\times10^{-5}$ Pa).

In the image displays using the display panel described above, electrons are emitted from each of the cold cathode elements 1012 when applying a voltage to each of the elements 1012 through the terminals Dx1 to Dxm and Dy1 to Dyn outside the container. When applying a voltage of from several hundreds volt [V] to several kilovolt [kV] to the metal back 1019 through the terminal Hv outside the container while applying a voltage to each element 1012, the above emitted electrons are accelerated and collide against the inner surface of the face plate 1017. This excites the differently colored fluorescent substances constituting the fluorescent film 1018 and allows them to emit light, which leads to displaying images.

Normally, the voltage applied to the surface conduction type electron emission device 1012, which is a cold cathode element, of the present invention is from about 12 to 16 [V], the distance d of the metal back 1019 from the cold cathode electrode 1012 is from about 0.1 [mm] to 8 [mm], and the voltage between the metal back 1019 and the cold cathode electrode 1012 is from about 0.1 [kV] to 10 [kV].

The basic construction of the display panel embodying the present invention and the production method thereof as well as the rough summary of the image display have been described above.

Now the method of producing a multiple electron beam source used for the display panel of the above embodiment will be described. Any multiple electron beam sources can be used for the image display of the present invention as long as multiple cold cathode elements are arranged in a simple matrix and wired or they are arranged in a ladder form and wired. The material, shape and production method of the cold cathode elements are not restricted at all. Thus, cold cathode elements such as surface conduction type electron emission devices, FE type elements or MIM type elements are all applicable.

Among these types cold cathode elements, however, the surface conduction type electron emission devices are especially preferable, if an image display is required such that its display screen is large and its price is low. Specifically, in FE type elements, their electron emission properties are largely dependent on the relative position of an emitter cone and a gate electrode as well as their shape, consequently their production technique requires an extremely high accuracy. This is a disadvantageous factor when trying to achieve an enlarged display screen or a reduced production cost. In MIM type elements, it is required that the film thickness of the insulating layer and the upper electrode should be thin and uniform. This is also a disadvantageous factor when trying to achieve an enlarged display screen or a reduced production cost. In that respect, in the surface conduction type electron emission devices, their production method is relatively simple, therefore, it is easy to obtain an enlarged display screen and reduce the production cost. Further, it has been found by the present inventors that, among the surface conduction type electron emission devices, the one whose electron emission portion or its periphery is formed with fine-particle film is especially excellent in electron emission properties and easy to produce. Accordingly, the above one can be said to be most suitable for use in the multiple electron beam sources of image displays having a high luminance and a large screen. Thus, in the display panel of the above embodiment were used the surface conduction type electron emission devices whose electron emission portion or its periphery is formed with fine-particle film. Now the basic construction of the suitable surface conduction type electron emission devices, the production method thereof and the characteristics thereof will be described, followed by describing the structure of the multiple electron beam source in which multiple elements are wired in a simple matrix.

[Suitable Construction of Surface Conduction Type Electron Emission Devices and Method of Producing Thereof]

There are two types of typical construction of surface conduction type electron emission devices in which the electron emission portion or its periphery is formed of fine-particle film: planar type and vertical type.

[Planar Surface Conduction Type Electron Emission Devices]

First, the construction of planar surface conduction type electron emission devices and the production method thereof will be described. Referring to FIGS. 10A and 10B, FIGS. 10A and 10B are a plan view and a sectional view, respectively, illustrating the construction of a planar surface conduction type electron emission device. In the figures, reference numeral 1011 designates a substrate, numerals 1102 and 1103 element electrodes, 1104 a conductive thin film, 1105 an electron emission portion formed by energization forming processing, and 1113 a film formed by energization activation processing.

For the substrate 1011, various types glass substrates including, for example, quartz glass and green sheet glass, various types ceramics substrates including alumina, or the above various types substrates with an insulating layer of, for example, $SiO_2$ laminated thereon can be used.

The element electrodes 1102 and 1103 provided opposite to each other on the substrate 1011 parallel thereto are formed of conductive materials. The material may be properly selected from the group consisting of metals including, for example, Ni, Cr, Au, Mo, W, Pt, Ti, Cu, Pd and Ag or their alloys, metal oxides including $In_2O_3$—$SnO_2$, semiconductor such as poly-silicon and so on. The element electrodes 1102 and 1103 can be easily formed by combining the film formation technique such as vacuum deposition and the patterning technique such as photolithography and etching, however the other techniques (for example, printing technique) may also be used.

The shape of the element electrodes 1102 and 1103 is properly designed to suit for the purpose of applying the electron emission device concerned. Generally, the elements are usually designed in such a manner that the electrodes are spaced at intervals ranging from several hundreds Å to several hundreds μm. In order to apply the elements to an image display, preferably the intervals are selected in the range of several μm to several tens μm. The thickness of the element electrodes d is properly selected among the values ranging from several hundreds Å to several μm.

In the portion of the conductive thin film 1104, fine-particle film is used. The fine-particle film mentioned herein means the film containing multiple fine particles (including island-shaped aggregation) as a component. When microscopically examining the fine-particle film, the structure is observed where individual fine particles are spaced at certain intervals, or they are adjacent to each other, or they are overlapping with each other.

The diameter of the fine particles used in the fine-particle film is in the range of several Å to several thousands Å, preferably in the range of 10 Å to 200 Å. The thickness of the fine-particle film is properly set considering the conditions described below. That is, the conditions required under which the film is electrically satisfactorily connected with the element electrodes 1102 and 1103, the conditions required under which the film satisfactorily undergoes energization forming, the conditions required under which the electric resistance of the film itself has a proper value as described below, and so on. In particular, the thickness of the fine-particle film is set for any one of the values ranging from several Å to several thousands Å, preferably any one of the values ranging from 10 Å to 500 Å.

The materials may be used in the formation of the fine-particle film is properly selected from the group consisting of, for example, metals including Pd, Pt, Ru, Ag, Au, Ti, In, Cu, Cr, Fe, Zn, Sn, Ta, W and Pb, oxides including PdO, $SnO_2$, $In_2O_3$, PbO and $Sb_2O_3$, borides including $HfB_2$, $ZrB_2$, $LaB_6$, $CeB_6$, $YB_4$ and $GdB_4$, carbides including TiC, ZrC, HfC, TaC, SiC and WC, nitrides including TiN, ZrN and HfN, semi-conductor including Si and Ge, and carbon.

The conductive thin film 1104 is formed of fine-particle thin film, as described above, and its sheet resistivity is set for any one of the values ranging from $10^3$ to $10^7$ Ω/□.

Since it is desirable that the conductive thin film 1104 and the element electrodes 1102 and 1103 are electrically satisfactorily connected, the structure of the elements is designed in such a manner that both of them partly overlap with each other. The substrate, the element electrodes and the conductive thin film are laminated in this ascending order in the example shown in FIGS. 10A and 10B, however, the substrate, the conductive thin film and the element electrodes may be laminated in this ascending order depending on the situation.

The electron emission portion 1105 is the crack-shaped portion formed on a part of the conductive thin film 1104 and electrically more resistive than its surroundings. The crack is formed by subjecting the conductive thin film 1104 to energization forming processing describe below. There are cases in which the fine particles of several Å to several hundreds Å in diameter are arranged in the crack. Incidentally, it is very difficult to illustrate the details of the position and shape of the actual electron emission portion precisely and exactly, therefore, they are schematically shown in FIGS. 10A and 10B.

The thin film 1113 is a film formed of carbon or its compound which coats the electron emission portion 1105 and its vicinities. The thin film 1113 is formed by subjecting the conductive thin film 1104 to energization activation processing after energization forming processing.

The thin film 1113 is formed of any one of single crystal graphite, polycrystal graphite and noncrystalline carbon, or the mixture thereof, and its thickness is preferably 500 [Å] or lower, more preferably 300 [Å] or lower. Incidentally, it is very difficult to illustrate the details of the position and shape of the actual thin film 1113, therefore, they are schematically shown FIGS. 10A and 10B. In the plan view, FIG. 10A, the element is shown with the part of the thin film 1113 (the upper layer above 1105 removed.

The basic construction of preferred elements has been described above, and in the preferred embodiments used were the elements described below.

That is, for the substrate 1011 used was green sheet glass and for the element electrodes 1102 and 1103 used was Ni thin film. The thickness d of the element electrodes 1102 and 1103 was 1000 [Å], and their interval L was 2 [μm].

For the main material of the fine-particle film used was Pd or PdO, and the thickness and width W of the fine-particle film were 100 [Å] and 100 [μm], respectively.

Now the method of producing preferable planar surface conduction type electron emission devices will be described. Referring to the drawings, FIGS. 15A to 15E are sectional views illustrating the process of producing of surface conduction type electron emission devices. The reference numeral of each member corresponds to that of FIGS. 10A and 10B described above.

Figure 15A:
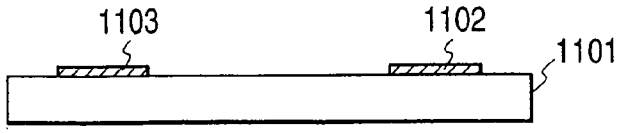
FIGS. 15A, 15B, 15C, 15D and 15E are sectional views showing the production process of a planar surface conduction type electron emission device.

1) First, the element electrodes 1102 and 1103 are formed on the substrate 1011 as shown in FIG. 15A.

The substrate 1011 is cleaned sufficiently using a cleaning agent, deionized water and an organic solvent prior to forming the electrodes, then the material of element electrodes is deposited thereon. As a method of deposition, vacuum film formation techniques such as vacuum deposition, sputtering and so on are applicable. Succeedingly, the electrode material deposited is patterned using photolithography/etching techniques so as to form a pair of element electrodes 1102 and 1103 shown in FIG. 15A.

Figure 15B:
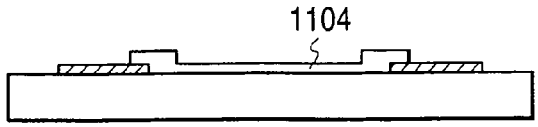

2) Second, the conductive thin film 1104 is formed, as shown in FIG. 15B.

When forming the thin film 1104, first the substrate shown in FIG. 15A is subjected to application of organic metal solution and drying, then a fine-particle thin film is formed thereon by heat firing processing, after which the thin film is patterned into a prescribed form by photolithography/etching. The organic metal solution mentioned herein means a solution of an organic metal compound of that main element is the same as the fine-particle material used in the conductive thin film. In particular, the main element used in the present embodiment was Pd. Although dipping process was used in the present embodiment as an application process, the other processes, for example, spinner process and spray process, are also applicable.

As a method of forming the conductive thin film 1104 of fine-particle film, the methods other than the one used in the present embodiment in which an organic metal solution is applied to the substrate, for example, vacuum deposition, sputtering and chemical vapor phase deposition can be used.

Figure 15C:
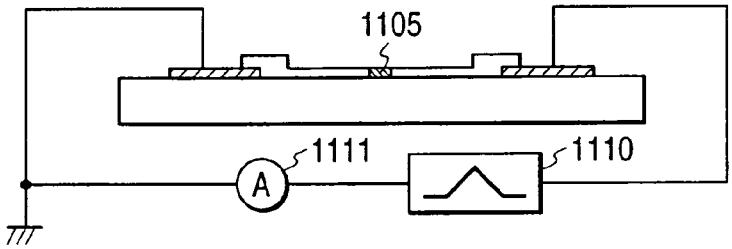

3) The electron emission portion 1105 is formed by conducting energization forming in which a proper voltage is applied between the element electrodes 1102 and 1103 through the forming source 1110 as shown in FIG. 15C.

Energization forming processing means that the conductive thin film 1104 formed of fine-particle film is energized to undergo a proper fracture, deformation or change in quality in a part thereof, so that its structure is suitably changed. In the portion of the conductive thin film formed of fine-particle film whose structure has undergone a change suitable for performing electron emission (that is, the electron emission portion 1105), the thin film has a proper crack formed on it. The electric resistance measured between the element electrodes 1102 and 1103 substantially increases after the electron emission portion 1105 is formed as compared with before its formation.

Figure 16:
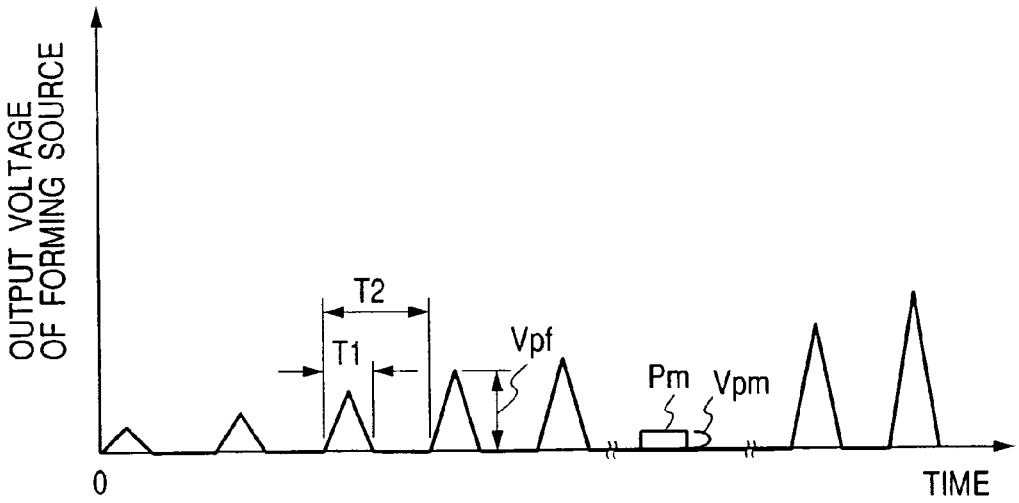
FIG. 16 is a voltage waveform presentation during energization forming processing.

In order to explain the energization processing more in detail, one example of the waveforms of a proper voltage applied through the forming source 1110 is shown in FIG. 16. When subjecting the conductive thin film 1104 formed of fine-particle film to the forming processing, preferably a pulse voltage is applied to the film. And in the present embodiment a triangular pulse voltage with a pulse width of T1 and a pulse spacing of T2 is continuously applied to the conductive thin film as shown in FIG. 16. In that case, the peak value of the triangular pulse voltage Vpf is increased step by step. A monitor pulse Pm for monitoring the state in which the electron emission portion 1105 is formed is inserted between the triangular pulses at a proper interval, and the current flow was measured with an ammeter 1111.

In the present embodiment, the peak value Vpf was adjusted in 0.1 [V] increments for each pulse under a vacuum atmosphere of the order of, for example, $10^{-5}$ [Torr] ($1.33\times10^{-3}$ Pa) while setting, for example, the pulse width T1 for 1 [msec] and pulse spacing T2 for 10 [msec]. The monitor pulse Pm was inserted once per every five triangular pulses. The voltage of the monitor pulse Vpm was set for 0.1 [V] in order not to affect the forming processing. The energization involved in the forming processing was terminated at the stage where the electric resistance between the element electrodes 1102 and 1103 became $1\times10^{6}$ [Ω], that is, the current measured with the ammeter 1111 while applying the monitor pulse became $1\times10^{-7}$ [A].

The above method is preferable with respect to the surface conduction type electron emission devices of the present embodiment; accordingly, if the design of the surface conduction type electron emission devices, such as the material or thickness of the fine-particle film or the intervals L of the element electrodes, is changed, desirably the energization conditions are properly changed.

Figure 15D:
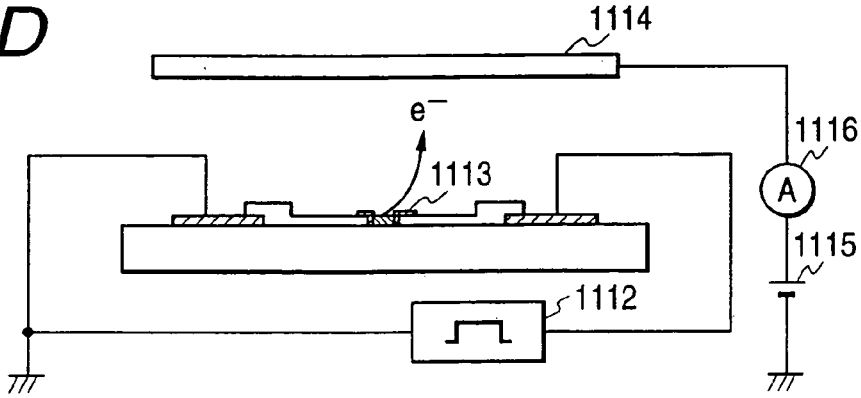

4) The electron emission properties are improved by conducting an energization activation processing in which a proper voltage is applied between the element electrodes 1102 and 1103 using an activation source 1112 as shown in FIG. 15D.

The energization activation processing means that carbon or its compound is caused to deposit in the vicinity of the electron emission portion 1105, which is formed by the above energization forming processing, by subjecting the portion to energization under proper conditions. (In the Figure, the deposition of carbon or its compound is schematically shown as a member 1113.) Typically, the energization activation processing provides a 100-fold or more increase in emission current as compared with before conducting the processing.

In particular, carbon or its compound originated from the organic compounds existing in a vacuum atmosphere is deposited in the vicinity of the electron emission portion 1105 by applying voltage pulses to the portion at regular intervals under a vacuum atmosphere within the range of $10^{-5}$ to $10^{-4}$ [Torr] ($1.33\times10^{-3}$ to $1.33\times10^{-2}$ Pa). The deposition 1113 is any one of single crystal graphite, polycrystal graphite and non-crystalline graphite, or the mixture thereof, and its thickness is preferably 500 [Å] or smaller, more preferably 300 [Å] or smaller.

Figure 17A:
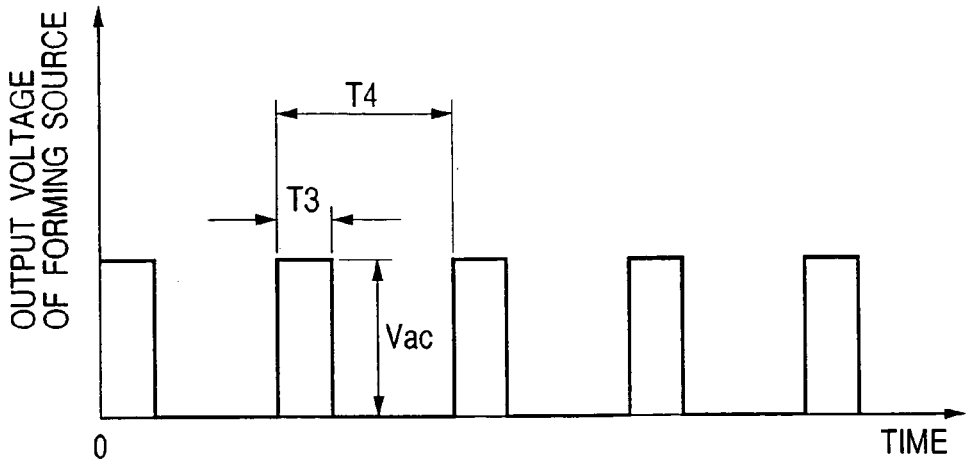
FIG. 17A is a voltage waveform presentation during energization activation processing.

In order to explain the energization processing more in detail, one example of the waveforms of a proper voltage applied through the activation source 1112 is shown in FIG. 17A. In the present embodiment, the energization activation processing was conducted by applying a rectangular wave of a certain voltage at regular intervals. In particular, the voltage of the rectangular wave Vac was 14 [V], the pulse width T3 was 1 [msec] and the pulse spacing T4 was 10 [msec]. The above energization conditions are preferable with respect to the surface conduction type electron emission devices of the present embodiment; accordingly, if the design of the surface conduction type electron emission devices is changed, desirably the conditions are properly changed.

Figure 17B:
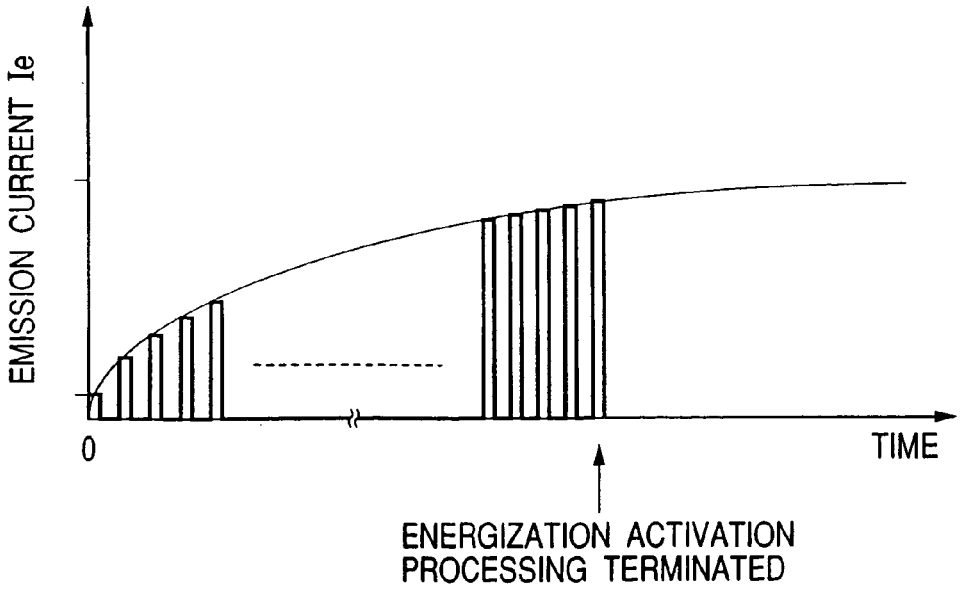
FIG. 17B is a presentation of the variation of emitted current Ie with time.

Referring to the drawings, reference numeral 1114 shown in FIG. 15D designates an anode electrode for capturing the emission current Ie emitted from the above surface conduction type electron emission device, and it is connected with a direct current high voltage source 1115 and an ammeter 1116. (In cases where the activation processing is conducted after incorporating the substrate 1011 into the display panel, the fluorescent surface of the display panel is used as an anode electrode 1114.) While applying a voltage from the activation source 1112, the progress of the energization activation processing is monitored by measuring the emission current Ie with the ammeter 1116 and the operation of the activation source 1112 is controlled. One example of the emission currents Ie measured with the ammeter 1116 is shown in FIG. 17B. When starting to apply a pulse voltage from the activation source 1112, the emission current Ie increases with time, but it becomes saturated before long and comes to hardly increase. The energization activation processing is terminated at a time when the emission current Ie is almost saturated by stopping the application of the voltage from the activation source.

Incidentally, the above energization conditions are preferable with respect to the surface conduction type electron emission devices of the present embodiment; accordingly, if the design of the surface conduction type electron emission devices is changed, desirably the conditions are properly changed.

Figure 15E:
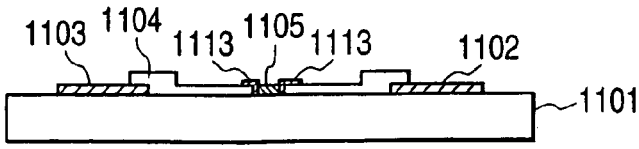

The planar surface conduction type electron emission device shown in FIG. 15E was thus produced.

[Vertical Surface Conduction Type Electron Emission Devices]

Now, another typical construction of surface conduction type electron emission devices whose electron emission portion or periphery is formed with fine-particle film, that is, the construction of vertical surface conduction type electron emission devices will be described.

Figure 18:
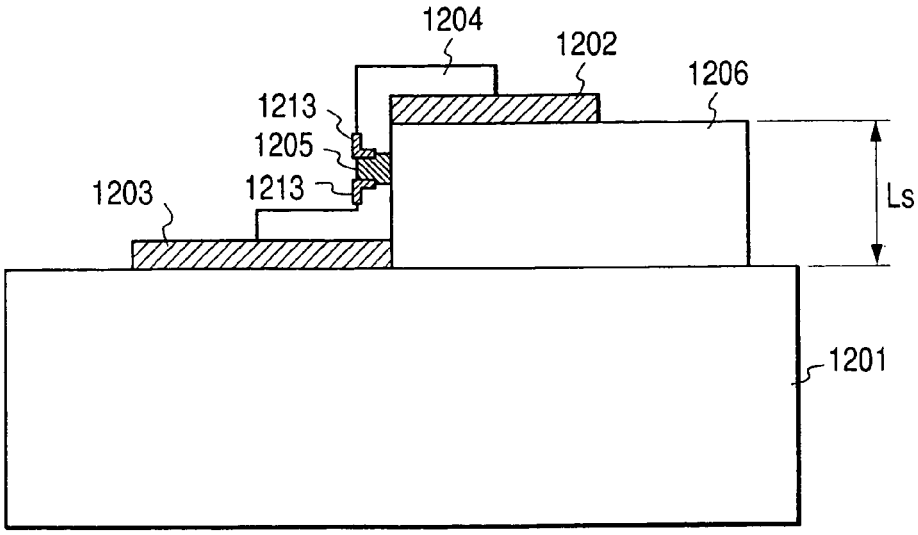
FIG. 18 is a sectional view of the vertical surface conduction type electron emission device used in one embodiment of the present invention.

Referring to the drawings, FIG. 18 is a sectional view of a vertical surface conduction type electron emission device illustrating its basic construction. In the figure, reference numeral 1201 designates a substrate, each of numerals 1202 and 1203 an element electrode, numeral 1206 a step formation member, numeral 1204 a conductive thin film using fine particles film, numeral 1205 an electron emission portion formed by conducting energization forming processing, and numeral 1213 a thin film formed by conducting energization activation processing.

The vertical type differs from the planar type in that one of the element electrodes (1202) is provided on the step formation member 1206 and one of the side surfaces of the step formation member 1206 is coated with the conductive thin film 1204. Accordingly, the intervals of the element electrodes L in the planar type shown in FIGS. 10A and 10B is set as a step height L of the step formation member 1206 in the vertical type. As for the materials of the substrate 1201, element electrodes 1202 and 1203, and the conductive thin film 1204 using fine-particle film, the materials listed in the description of the above planar type are applicable. For the step formation member 1206, an electrically insulating material such as $SiO_2$ is used.

Now, the method of producing vertical surface conduction type electron emission devices will be described. Referring to the drawings, FIGS. 19A to 19F are sectional views for illustrating the production process of the vertical surface conduction type electron emission devices, and reference numerals of each member designate the same member as in FIG. 18 described above.

Figure 19A:
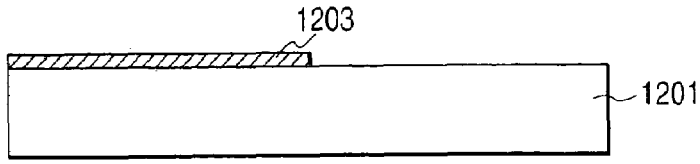
FIGS. 19A, 19B, 19C, 19D, 19E and 19F are sectional views showing the production process of a vertical surface conduction type electron emission device.

1) An element electrode 1203 is formed on the substrate 1201 as shown in FIG. 19A.

Figure 19B:
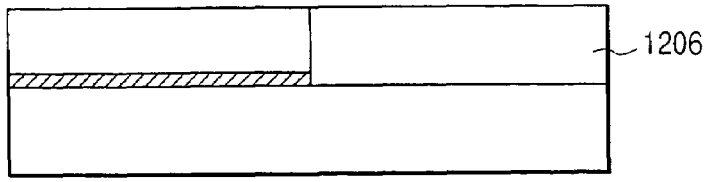

2) An insulating layer for forming the step formation member on it is laminated as shown in FIG. 19B. While the insulating layer is laminated with, for example, $SiO_2$ by sputtering, the other film formation processes such as vacuum deposition and printing process are also applicable.

Figure 19C:
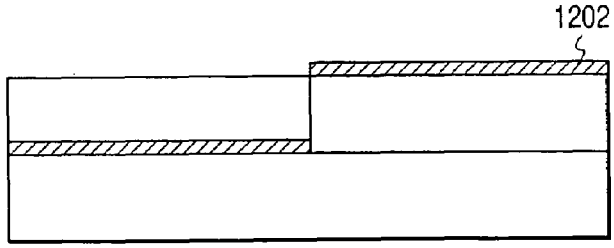

3) An element electrode 1202 is formed on the insulating layer as shown in FIG. 19C.

Figure 19D:
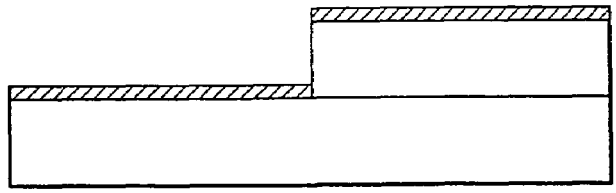

4) Part of the insulating layer is removed by, for example, an etching method so as to expose the element electrode 1203, as shown in FIG. 19D.

Figure 19E:
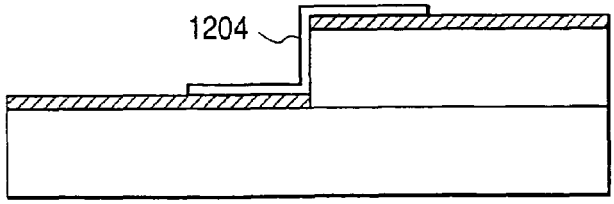

5) A conductive thin film 1204 using fine-particle film is formed as shown in FIG. 19E. For this film formation, film formation techniques such as application process can be used, like the above planar type.

6) Like the above planar type, an electron emission portion is formed by conducting energization forming processing. (The similar energization forming processing as described using FIG. 15C may be conducted.)

7) Like the above planar type, carbon or its compound is caused to deposit in the vicinity of the electron emission portion by conducting energization activation processing. (The similar energization activation processing as described using FIG. 15D may be conducted.)

Figure 19F:
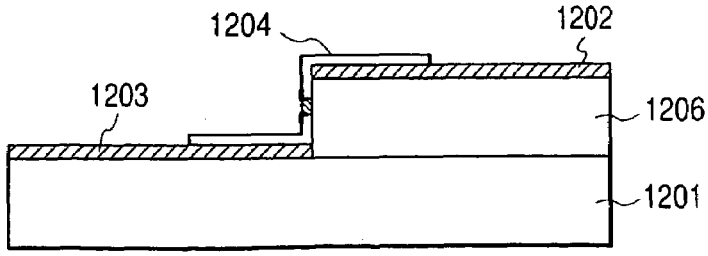

The vertical surface conduction type electron emission device shown in FIG. 19F was thus produced.

[Properties of Surface Conduction Type Electron Emission Devices Used in Image Producer]

The construction of the planar and vertical surface conduction type electron emission devices and the production method thereof have been described, and now the properties of the elements used in an image display will be described.

Figure 20:
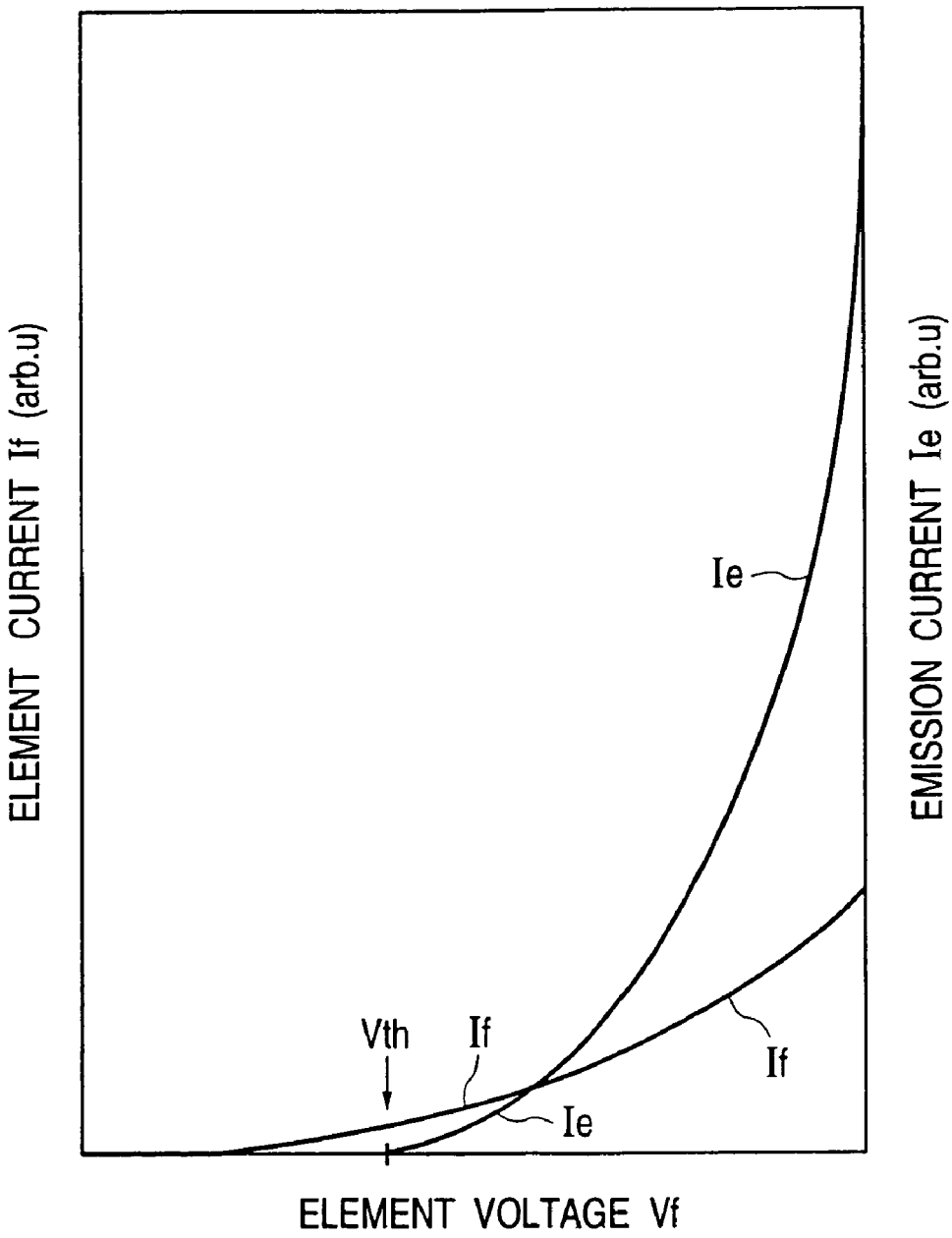
FIG. 20 is a graph showing the typical property of the surface conduction type electron emission device used in one embodiment of the present invention.

Referring to the drawings, FIG. 20 shows typical examples of (Emission Current Ie) to (Element Voltage Vf) and (Element Current If) to (Element Voltage Vf) properties. The emission current Ie is significantly small as compared with the element current If, therefore, it is very difficult to illustrate them with the identical scale, in addition, the above properties change with changes in design parameter, such as size of element, shape of the same and so on. Thus, the two properties are illustrated in their respective desired units.

The elements used in an image display have three properties described below, related to emission current Ie.

First, the emission current Ie rapidly increases when the voltage equal to or higher than the voltage of a certain value (referred to as "threshold voltage Vth") is applied to the elements, while it is hardly detected when the voltage lower than the threshold voltage Vth is applied.

That is, the elements are non-linear elements having a definite threshold Vth with respect to the emission current Ie.

Second, the emission current Ie varies depending on the voltage Vf applied to the elements, therefore, the magnitude of the emission current Ie can be controlled by the voltage Vf.

Third, the current Ie emitted from the elements quickly responds to the voltage Vf applied thereto, therefore, the amount of charge of the electrons emitted from the elements can be controlled by the duration time of applying the voltage Vf.

The surface conduction type electron emission devices were suitably applied to an image display due to the above properties. For example, in the image display in which multiple elements are provided corresponding to the picture elements of its display screen, display is made possible by scanning the display screen in turn while taking advantage of the first property. That is, the voltage equal to or higher than the threshold voltage Vth is applied to the elements under drive according to the desired luminance, while the voltage lower than the threshold voltage Vth is applied to the elements in the non-selective state. Display is made possible by scanning the display screen in turn while switching the elements to be driven in turn.

Further, the luminance of the display screen can be controlled while taking advantage of the second or the third property, which makes possible a gradation display.

[Structure of Multiple Electron Beam Source with Multiple Elements Arranged in a Simple Matrix]

Now, the structure of a multiple electron beam source will be described in which the above surface conduction type electron emission devices are wired in a simple matrix.

Referring to the drawings, FIG. 11 is a plan view of the multiple electron beam used in the display panel of FIG. 8 described above. On the substrate 1011, arranged are the same surface conduction type electron emission devices 1012 as shown in FIGS. 10A and 10B, which are wired in a simple matrix with row wiring electrodes 1003 and column wiring electrodes 1004. On each portion where a row wiring electrode 1003 and a column wiring electrode 1004 intersect, an insulating layer (not shown in the figure) is formed between the electrodes to keep them electrically insulating.

FIG. 12 is a sectional view of the multiple electron beam source of FIG. 11, taken along the line 12-12.

The multiple electron beam source having such a structure was produced by first forming the row wiring electrodes 1013, the column wiring electrodes 1014, the insulating layers between the electrodes (not shown in the figure), the element electrodes of the surface conduction type electron emission devices 1012 and the conductive thin film on the substrate, then conducting energization forming processing and energization activation processing while feeding power to each element via the row wiring electrodes 1013 and the column wiring electrodes 1014.

[Construction of Driving Circuit (and Driving Method Thereof)]

Figure 21:
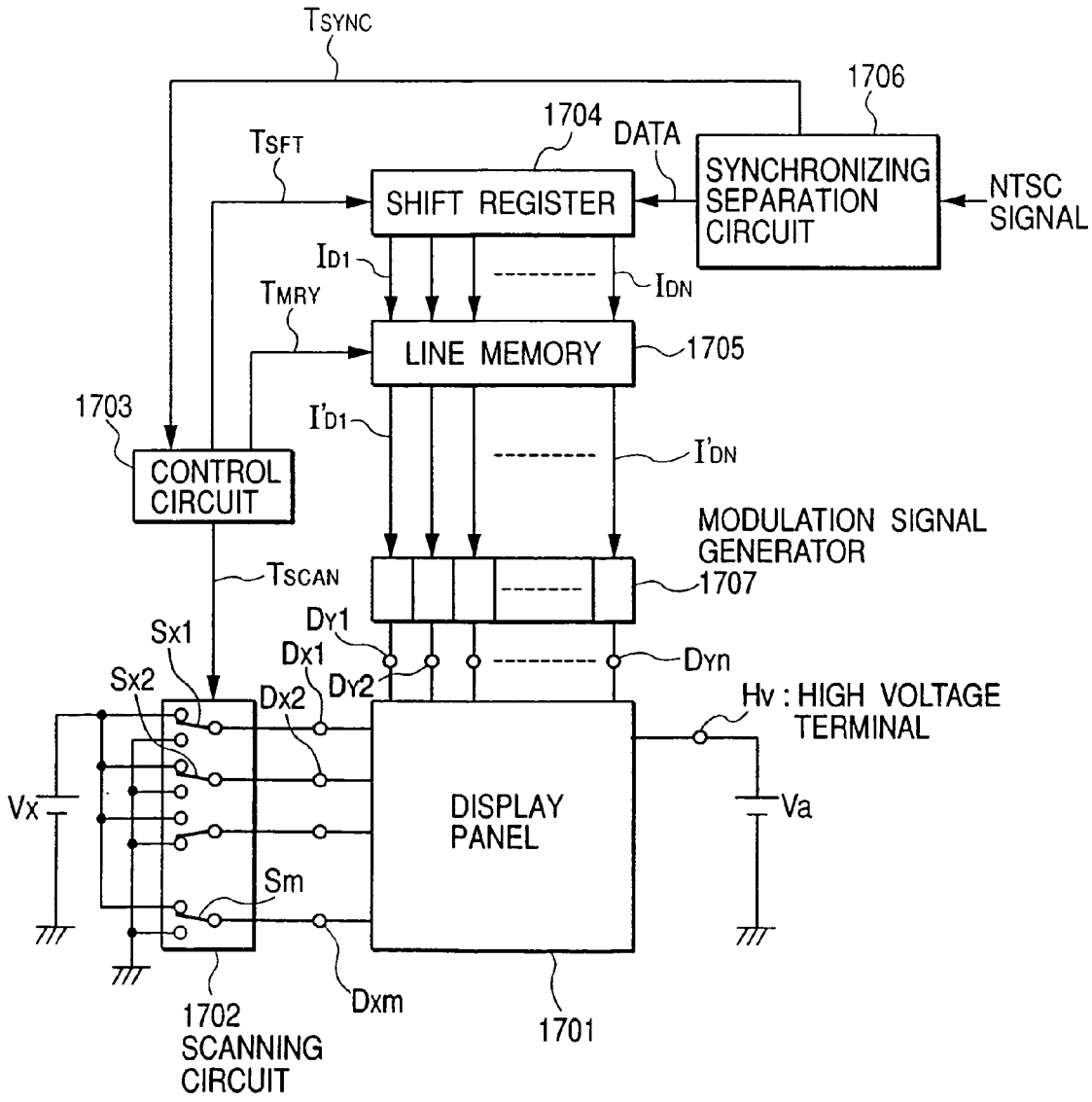
FIG. 21 is a block diagram schematically showing a configuration of a driving circuit of an image display embodying the present invention.

Referring to drawings, FIG. 21 is a block diagram schematically showing a configuration of driving circuit for displaying a television screen based on the NTSC television signals. In the figure, a display panel designated by reference numeral 1701 corresponds to the display panel described above, and it is produced and operates in the same manner as described above. A scanning circuit designated by numeral 1702 scans scanning lines, and a control circuit 1703 generates signals and the like input into the scanning circuit 1702. A shift register 1704 shifts data of each line, and a line memory 1705 outputs the data for one line from the shift register 1704 to a modulation signal generator 1707. A synchronizing signal separating circuit 1706 separates the synchronizing signals from NTSC signals.

The functions of each part of the circuit shown in FIG. 21 will be described in detail below.

The display panel 1701 is connected with an external electric circuit via terminals Dx1 to Dxm, terminals Dy1 to Dyn and a high voltage terminal Hv. To the terminals Dx1 to Dxm, applied are scanning signals for driving the multiple electron beam source provided in the display panel 1701, that is, for driving the cold cathode elements wired in a matrix of m rows and n columns one by one (n elements). On the other hand, to the terminals Dy1 to Dyn, applied are modulation signals for controlling the output electron beam of each of n elements for one row selected by the above scanning signals. And to the high voltage terminal Hv, a DC voltage of, for example, 5 [kV] is supplied from a DC voltage source Va. The above voltage means an accelerating voltage for providing a sufficient energy for the excitation of fluorescent substances to the electron beam output from the multiple electron beam source.

Then the scanning circuit 1702 will be described. The scanning circuit 1702 has m switching elements (in the figure, they are schematically shown by S1 to Sm) in it, and each of the switching elements selects either one of the output voltage of an DC voltage Vx and 0 [V] (GND level) and electrically connects with the terminals Dx1 to Dxm of the display panel 1701. Each switching element, S1 to Sm, operates according to the control signals Tscan output from the control circuit 1703, and actually it can be easily constructed by combining the switching elements like FET. The above DC voltage source Vx is set so that it will output a certain voltage to keep the driving voltage applied to the elements having been not scanned at a level equal to or lower than the electron emission threshold voltage Vth based on the properties of the electron emission devices illustrated in FIG. 20.

The control circuit 1703 has a function of coordinating the operations of each part so that an appropriate display will be made based on the image signals input from the outside. It generates control signals Tscan, Tsft and Tmry toward each part based on the synchronizing signals Tsync sent from a synchronizing signal separation circuit 1706 described below. The synchronizing signal separation circuit 1706 is a circuit for separating a synchronizing signal component and a luminance signal component from a NTSC television signal input from the outside. Although the synchronizing signal separated by a synchronizing signal separation circuit 1706 consists of a vertical synchronizing signal and a horizontal synchronizing signal, as is well known, it is shown as a Tsync signal in the figure for convenience. On the other hand, the luminance signal component of an image separated from the above television signal is referred to as DATA signal for convenience, and the signal is input into a shift register 1704.

The shift register 1704 is a register for subjecting the above DATA signal input into serial on the basis of time series to serial/parallel conversion for each image line, and it operates based on the control signal Tsft sent from the control circuit 1703. In other words, the control signal Tsft can be a shift lock of the shift register 1704. The data for 1 line of image subjected to serial/parallel conversion (corresponds to the driving data of n electron emission devices) are output from the above shift register 1704 as n signals of Id1 to Idn.

A line memory 1705 is a memory for storing the data for 1 line of image for a required period time, and it stores properly the contents of Id1 to Idn in accordance with control signal Tmry sent from the control circuit 1703. The contents stored are output as I'd1 to I'dn and input into a modulation signal generator 1707.

The modulation signal generator 1707 is a signal source for driving and modulating each of the electron emission devices 1012 according to each of the image data I'd1 to I'dn, and its output signal is applied to the electron emission devices 1015 within the display panel 1701 through the terminals Dy1 to Dyn.

As described above using FIG. 20, the surface conduction type electron emission devices in accordance with the present invention has basic properties described below for emission current Ie. That is, there exists a definite threshold voltage Vth in electron emission (in the case of the surface conduction type electron emission device described in the embodiment below, Vth is 8 [V]), electrons are emitted only when applying a voltage equal to or higher than the threshold voltage Vth. And under the voltage higher than the threshold voltage Vth, emission current Ie changes with changes in voltage as shown in the graph of FIG. 20. This means that, in cases where a panel voltage is applied to the elements of the present invention, when applying a voltage lower than the threshold voltage Vth, electron emission does not occur, on the other hand, when applying a voltage higher than the threshold voltage Vth, electron beam is output from the surface conduction type electron emission devices. Changing the peak value of the pulse Vm at that time makes possible controlling the intensity of the output electron beam. Further, changing the pulse width Pw makes possible controlling the total amount of charges of the output electron beam.

Thus, as a method of modulating electron emission devices according to input signals, a voltage modulation method, a pulse width modulation method and the like can be adopted. When executing the voltage modulation method, a circuit of a voltage modulation method in which a certain length of voltage pulse is generated and the peak value of the pulse is properly modulated in accordance with the data input can be used as a modulation signal generator 1707. When executing the pulse width modulation method, a circuit of a pulse width modulation type in which a certain peak value of voltage pulse is generated and the pulse width of the voltage is properly modulated in accordance with the data input can be used as a modulation signal generator 1707.

For the shift register 1704 and the line memory 1705, either a digital signal type or an analog signal type can be adopted. That is, it does not matter which type should be adopted as long as the serial/parallel conversion of an image signal and storing are conducted at a prescribed rate.

When using a digital signal type, though it is necessary that the output signal DATA from the synchronizing signal separation circuit 1706 is converted into digital signals, this can be done if only an A/D converter is provided at the output portion of the synchronizing signal separation circuit 1706. In connection with this, the circuit used for the modulation signal generator varies depending on whether the output signals of the maim memory 115 is digital or analog. Specifically, in case of the voltage modulation method using digital signals, for example, an D/A conversion circuit is used for the modulation signal generator 1707, and an amplification circuit or the like is added if necessary. In case of the pulse width modulation method, a circuit combined with a counter for counting the number of waves output from a high-speed oscillator or an oscillator and a comparator for comparing the output values of the counter and the above memory is used for modulation signal generator 1707. If necessary, an amplifier can be added for amplifying the voltage of the signals subjected to a pulse width modulation and output from the comparator to the driving voltage of the electron emission devices.

In case of the voltage modulation method using analog signals, for example, an amplification circuit using an operational amplifier is adopted for the modulation signal generator 1707, and a shift-level circuit or the like may be added if necessary. In case of the pulse width modulation method, a voltage controlling type oscillation circuit (VCO) can be adopted. If necessary, an amplifier can be added for amplifying the voltage to the driving voltage of the electron emission devices.

In a image display to which the present invention having such a construction is applicable, electrons are emitted by applying a voltage to each of the electron emission devices via terminals, Dx1 to Dxm and Dy1 to Dyn, outside the container. The electron beam is accelerated as a result of applying a high voltage to the metal back 1019 or the transparent electrode (not shown in the figures) via the high voltage terminal Hv. The accelerated electrons collide with the fluorescent film 1018, which causes light emission and consequently produces an image.

[Electron Beam Source having a Ladder-shaped Arrangement]

Now an electron source substrate having a ladder-shaped arrangement and an image display using the same will be described with reference to FIGS. 22 and 23.

Figure 22:
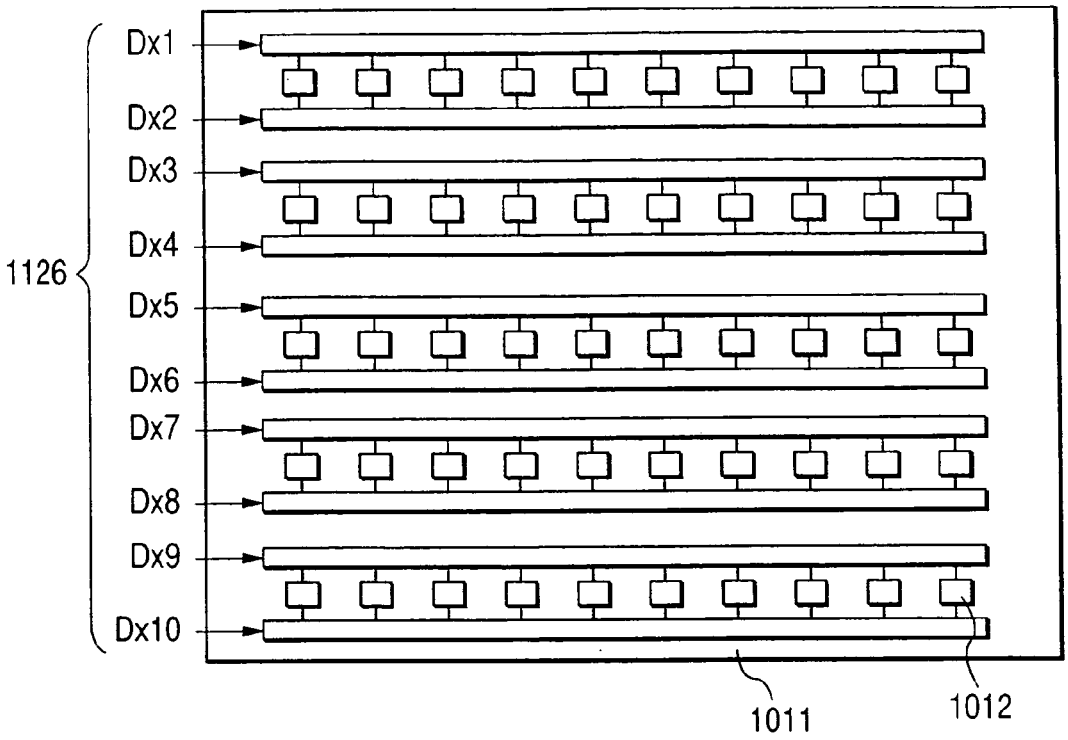
FIG. 22 is a schematic plan view showing a ladder arrangement electron source of one form of the present invention.
Figure 24:
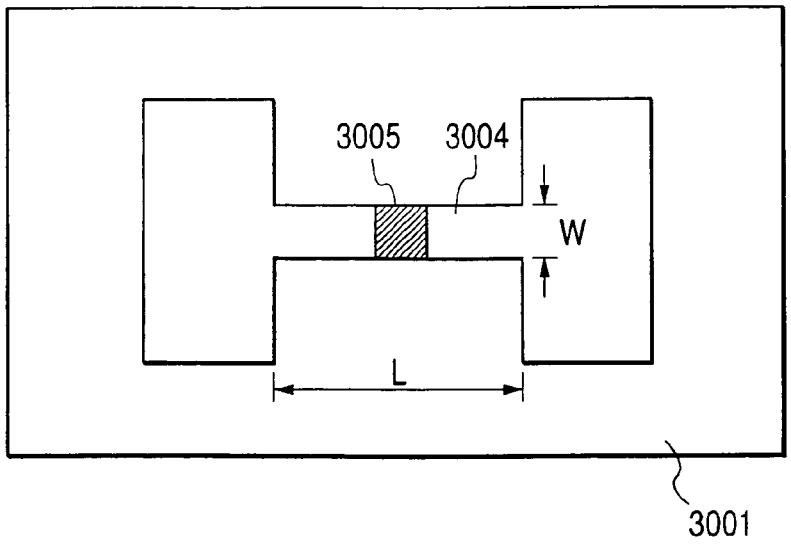
FIG. 24 is a schematic diagram of one example of the conventional surface conduction type electron emission device.

Referring to FIG. 22, reference numeral 1011 designates an electron source substrate, numeral 1012 electron emission devices, and Dx1 to Dx10 of numeral 1126 common wiring connecting with the above electron emission devices. Multiple electron emission devices 1012 are arranged in parallel with a row in the direction of X on the substrate 1011. (this is referred to as element row). An electron source substrate having a ladder-shaped arrangement is produce by arranging multiple element rows on the substrate. Each of the element rows can be driven independently by properly applying a driving voltage between the common wiring of each element row. Specifically, a voltage higher than the threshold voltage Vth is applied to the element rows from which electron beam is to be emitted, and a voltage lower than the threshold voltage Vth is applied to the element rows from which no electron beam is to be emitted. The common wiring, for example, Dx2 and Dx3 of Dx2 to Dx9 may be the same wiring.

Figure 23:
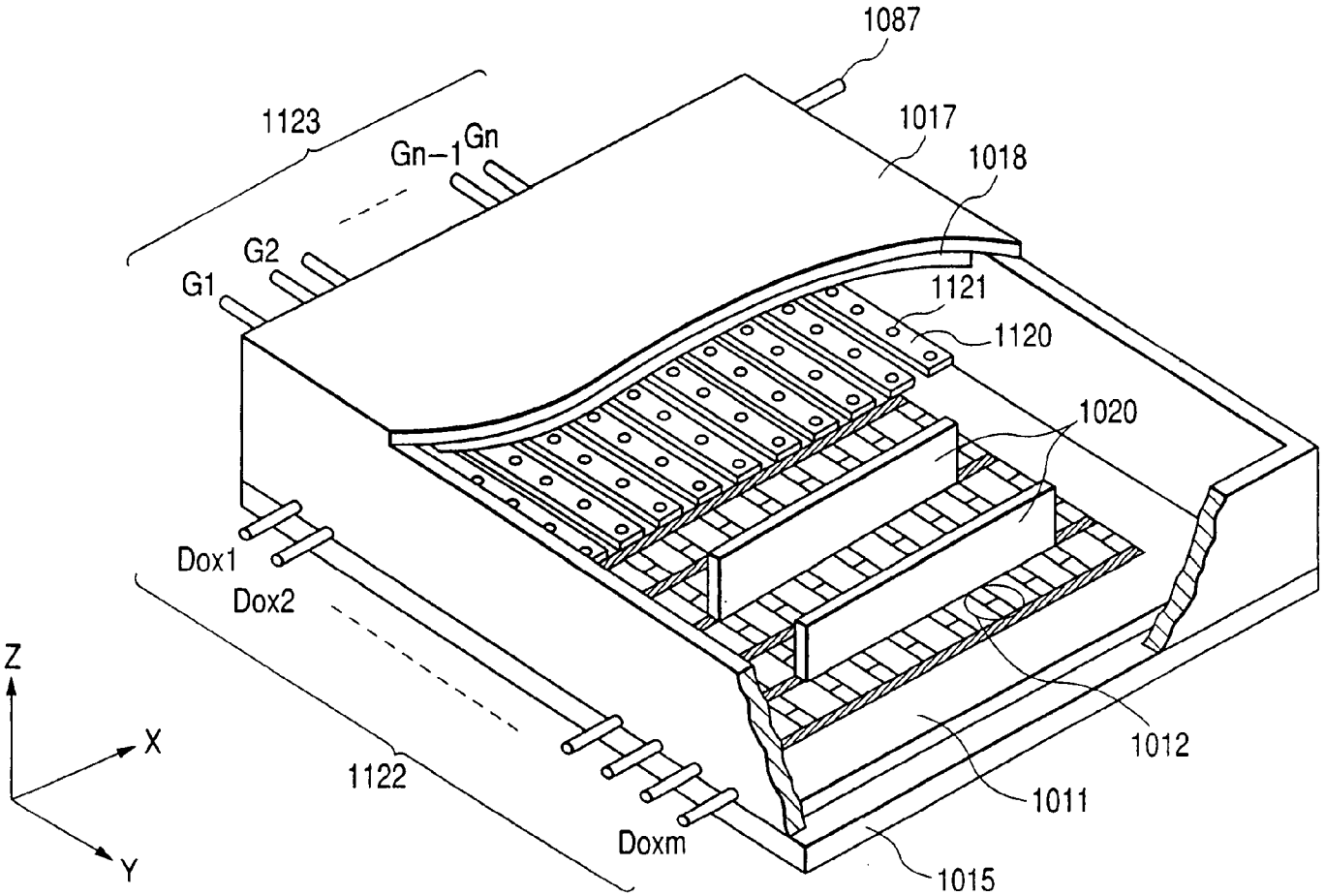
FIG. 23 is a perspective view of a planar image display containing a ladder arrangement electron source of one form of the present invention.
Figure 25:
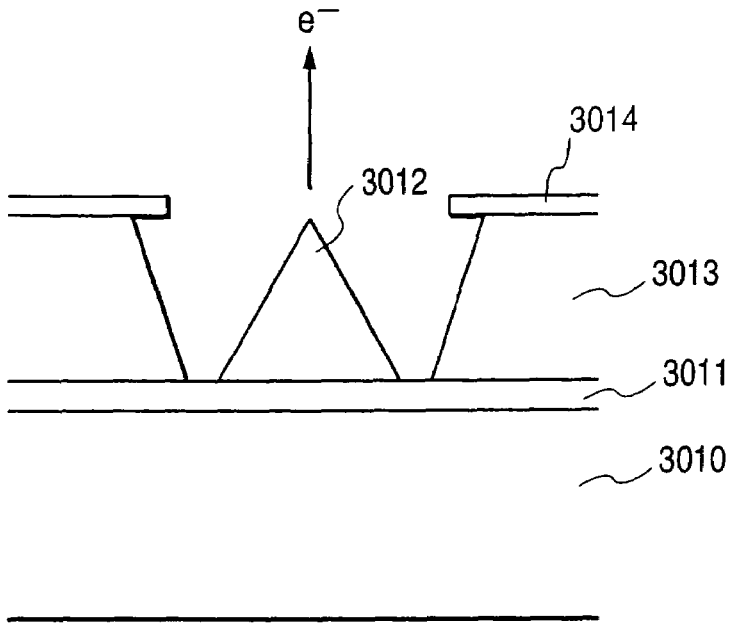
FIG. 25 is a schematic diagram of one example of the conventional FE type element.
Figure 26:
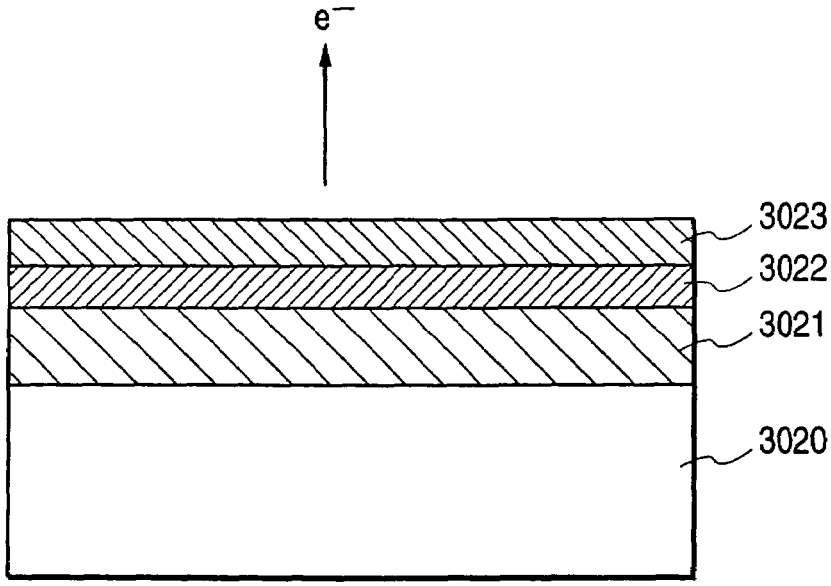
FIG. 26 is a schematic diagram of one example of the conventional MIM type element.
Figure 27:
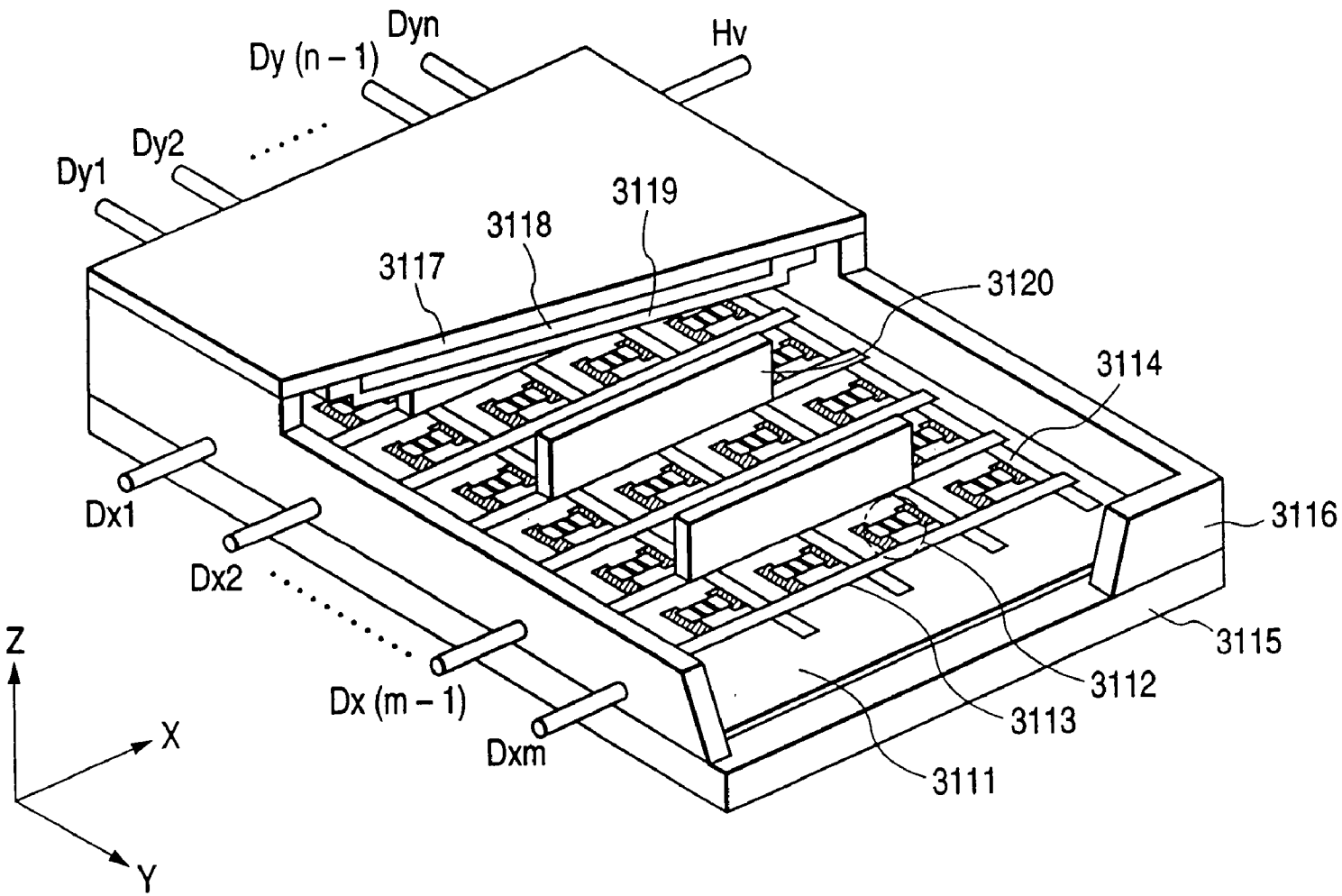
FIG. 27 is a perspective view of a display panel, partially broken away, of the conventional planar image display.

FIG. 23 shows a structure of an image display provided with an electron source having a ladder-shaped arrangement. Reference numeral 1120 designates grid electrodes, 1121 pores for allowing electrons to pass through, 1122 terminals outside of the container consisting of Dox1, Dox2, . . . Dox, 1123 terminals outside of the container consisting of G1, G2, . . . Gn connecting with the grid electrodes 1120, 1011 an electron source substrate in which each common wiring between the element rows is the same. The same reference numerals in FIG. 22 and FIG. 23 designate the same member. The difference between this type image producer and the image producer in a simple matrix arrangement (FIG. 8) is that this type image producer has grid electrodes 1120 provided between the electron source substrate 1011 and the face plate 1017.

In the panel structure described above, spacers 120 can be provided between the face plate 1017 and the rear plate 1015, if necessary in terms of its atmospheric-pressure structure, in both cases where the elements are arranged in a simple matrix and in a ladder-shaped form.

In the middle position between the substrate 1011 and the face plate 1017, provided are grid electrodes 1120. The grid electrodes 1120 can modulate the electron beam emitted from the surface conduction type electron emission devices 1012, and each grid electrode is provided with circular openings 1121 corresponding to each element to allow electron beam to pass through the electrodes provided in stripes perpendicular to the element rows in a ladder-shaped arrangement. The shape of the grids and the installation position thereof are not limited to those of FIG. 23. Multiple through-holes, as an opening, can be provided in a mesh form, and they can be provided around or in the vicinity of the surface conduction type electron emission devices.

The terminals 1122 outside the container and the grid terminals 1123 outside the container are electrically connected with the driving circuit shown in FIG. 21.

In the present image display, the exposure of the fluorescent substances to each electron beam can be controlled by applying modulation signals for 1 line of image to the grid electrodes and driving (scanning) the element rows line by line synchronously. Thus the image can be displayed line by line.

The construction of the above two image displays is an example of the image producers to which the present invention is applicable, and various changes and modifications can be made in it based on the concept of the present invention. Input signals have been described in terms of NTSC, they are, however, not limited to this, PAL method, SECAM, and TV signals (for example, high definition television) consisting of a larger number of scanning lines as compared with the former can also be adopted.

In accordance with the present invention, image producers for television broadcasting as well as image producers suitable for the image displays of video conference system, computers and the like can be provided. In addition, image producers as an optical printer comprising of a photographic drum can be provided.

EXAMPLES

The present invention will be explained more detail with reference to the concrete examples.

In the respective examples described below, used was the multiple electron beam source of a type in which N×M (N=3072, M=1024) surface conduction type electron emission devices having an electron emission portion on the conductive fine-particle film between electrodes are wired in a matrix with M direction rows of wiring and N direction columns of wiring (refer to FIGS. 8 and 11).

Example 1

Alumina Substrate, Board-shaped, Ruthenium Oxide Paste

The spacer used in this example was produced as described below.

As an original, used was a ceramic substrate produced with ratio of zirconia and alumina as 65:35, to have the same thermal expansion coefficient as a soda-lime glass substrate which was the same material of the rear plate. The original was subjected to polishing so that its outside dimensions of thickness, height and length would be 0.2 mm, 3 mm, and 40 mm, respectively. The average roughness of the substrate surface thus formed was 300 Å. Hereinafter the substrate is referred to as a0.

Prior to deposition processing, the above spacer substrate a0 was subjected to first ultrasonic cleaning in deionized water, IPA and acetone for 3 minutes, then drying at 80° C. for 30 minutes, and followed by UV ozone cleaning so as to remove organic residues on the surface of the substrate.

Then the surface was coated with 1108 resistive paste from DuPont by printing process and subjected to heat drying process at 800° C., which is higher than the softening point, about 600° C., of the first component, for 10 minutes in a heating furnace. The film thickness at this point was 2 μm and the roughness of the film surface was 180 Å. The back face of the substrate was also subjected to these coating and heating processes so that a highly resistive film was formed on both faces. Ruthenium oxide fired film coated the entire surface due to its step coverage, and the continuity of the film was satisfactory. For the film formed by co-deposition under the above conditions, the sheet resistivity was $R/\square=2\times10^9\ \Omega/\square$, and the first and the second cross point energies of secondary electron emission coefficient were 90 eV and 5 keV, respectively.

The functional components in this coating film were ruthenium oxide, which is a conductor as a second component, and $SiO_2$ and PbO, which are glass components as a first component. When observing the thus obtained film with a scanning electron microscope under a acceleration voltage of 10 kV, observed was a three-dimensional network structure of aggregated fine particles of ruthenium oxide as shown in the plan and sectional views of FIG. 1B. In the FIG. 3*a* was a glass component, 3*b* a fine particle of ruthenium oxide, and 3*c* observed in the interfacial region was an intermediately resistive region formed of Ru eluting into the glass component.

At this point, the secondary electron emission coefficient for each of the first and the second regions on the surface of the sample spacer of the present example (that is, the region 3*a* and the region consisting of 3*b* and 3*c*) were measured in the range of five incident energies, 1 keV, 2 keV, 3 keV, 5 keV and 10 keV, at a spot diameter of 50 nm or smaller, so as to obtain the incident energy dependency at each region. The energy dependency property was obtained by measuring the secondary electron emission coefficient for the region 3*a* and the region consisting of 3*b* and 3*c*. This property was determined for the above two regions as an energy dependency coefficient of electron penetration depth 1/(An) which is shown as a parameter in the general formula (0') obtained by fitting the aforementioned general formula (0) into regression analysis The incident energy dependency of electron penetration depth can be described as a function of effective electron density D and incident energy E shown with the general formula of $$dp=1/D*520*E^n\ (\text{Å})$$

wherein D represents electron density ($cm^{-3}$),

E represents incident energy (keV), thus the electron density of each region is determined. The ratio of electron density of the present example was obtained by standardizing the measured values of the region 3*a* and the region consisting of 3*b* and 3*c*, and the result was 2. The ratio of electron density is preferably 1.5 or more.

The antistatic film applicable to the present invention is not limited to this, various types antistatic film based on a network structure are applicable.

Further a low resistive film was formed in the region to become an upper to lower substrates junction portion by the method described below. The above region was subjected to vapor phase deposition to form a titanium film of 10 nm thickness and a Pt film of 200 nm thickness in sheet form parallel to the above junction portion by sputtering. The Ti film was provided as a foundation layer for reinforcing the film adhesion of the Pt film. The spacer 1020 with a low resistive film was thus obtained. Hereinafter thus obtained spacer is referred to as spacer A. The film thickness of the spacer A was 210 nm, and the sheet resistivity was 10 Ω/□.

FIG. 1A shows the construction of the film of spacer A in terms of its sectional view.

The incident angle dependency coefficient of secondary electron emission coefficient $m_0$ of spacer A was 3 for the incident electron energy of 1 kV.

In the present example, a display panel was produced in which the aforementioned spacers 1020 shown in FIG. 8 were arranged. The details will be described with reference to FIGS. 8 and 9. First, the substrate 1011 with row wiring electrodes 1013, column wiring electrodes 1014, insulating layers between electrodes (not shown in the figures) and the element electrode and conductive thin film of the surface conduction type electron emission devices 1012 formed on it was fixed on the rear plate 1015. Then the above spacers A, as a spacer 1020, were fixed on the row wiring electrodes 1013 of the substrate 1011 at regular intervals and parallel thereto. After that, a face plate 1017 with a fluorescent film 1018 and a metal back 1019 provided on its internal surface was arranged 5 mm above the substrate 1011 via side walls 1016, and the rear plate 1015, the face plate 1017, the side walls 1016 and the spacers 1020 were fixed at each junction portion. Frit glass (not shown in the figures) was applied to the substrate 1011 to rear plate 1015 junction, the rear plate 1015 to side wall 1016 junction and the face plate 1017 to side wall 1016 junction, and each of the junction portions was sealed by firing at 400° C. to 500° C. in the atmosphere for 10 minutes or longer. The spacers 1020 were arranged with their one side facing the substrate 1011 being on the row wiring 1013 (of 300 μm width) and the other side facing the face plate 1017 being on the metal back 1019 via a conductive filler or a conductive frit glass mixed with a conductive material such as metals (not shown in the figures). And their adhesion and electrical connection were achieved by firing them at 400° C. to 500° C. in the atmosphere for 10 minutes or longer at the same time that the above hermetic container was sealed.

Figure 14:
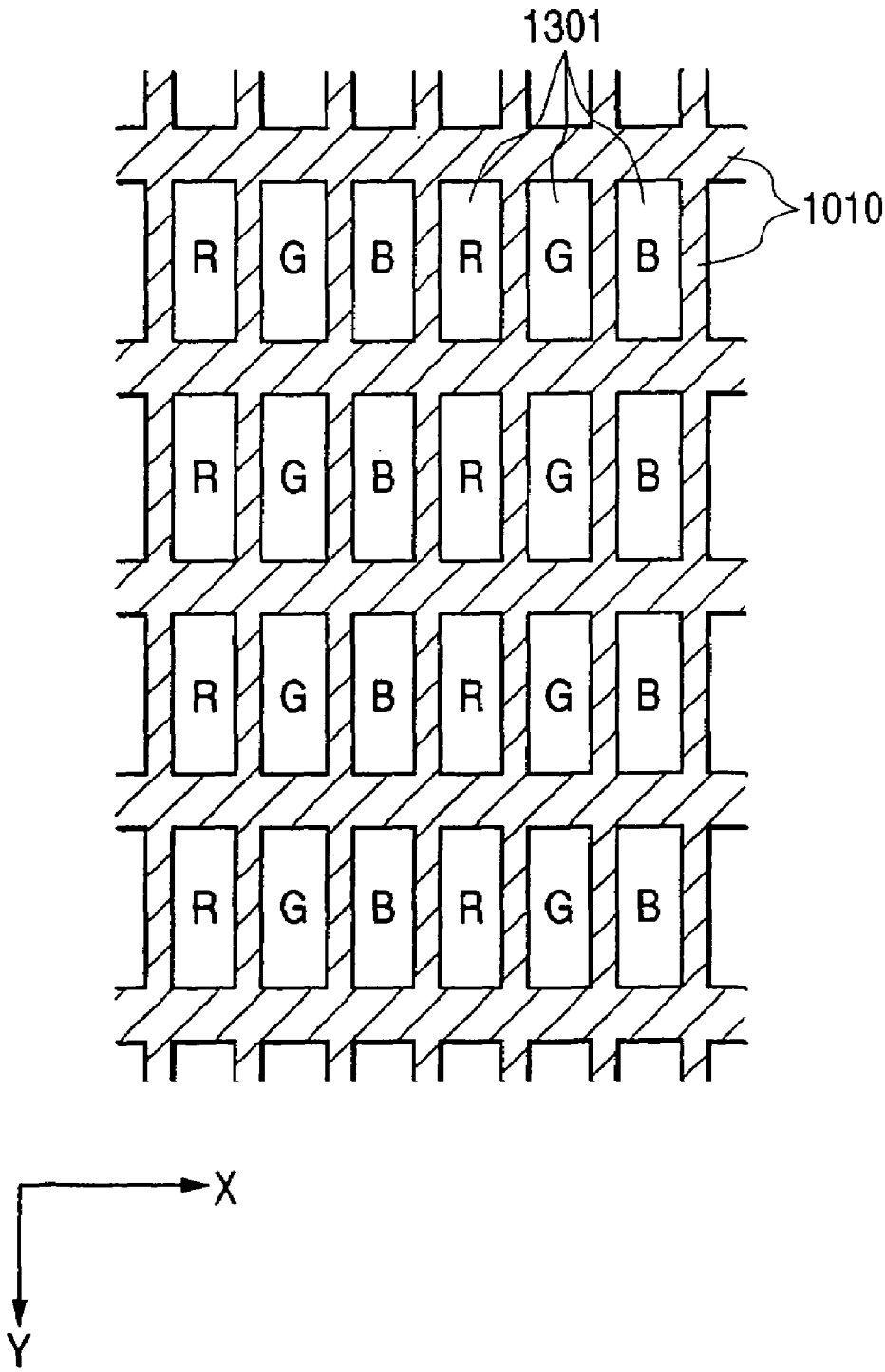
FIG. 14 is a plan view illustrating the arrangement of fluorescent substances on a face plate of a display panel.

In the present example, adopted was the fluorescent film 1018 which was formed, as shown in FIG. 14, in such a manner that fluorescent substances 1301 of the same color were placed in a column (in the direction of Y), multiple columnar lines of different colors form stripes, and black conductors 1010 are arranged between the two differently colored fluorescent substances (R, G, B) 1301 as well as between the two consecutive picture elements of the same color placed in the direction of Y. And the spacers 1020 were arranged within the region (of 300 μm width) parallel to each row of the black conductors 1010 (in the direction of X) via the metal back 1019. When conducting the sealing described above, the rear plate 1015, the face plate 1017 and the spacer 1020 were carefully positioned so that the each differently colored fluorescent substance will correspond to each element 1013 arranged on the substrate 1011.

After the hermetic container thus completed was evacuated with a vacuum pump through an exhaust tube (not shown in the figures) till it had a sufficient vacuum degree, the aforementioned energization forming processing and energization activation processing were conducted by feeding power to each element 1013 via the row wiring electrodes 1013 and the column wiring electrodes 1014 through the terminals Dx1 to Dxm and Dy1 to Dyn outside the hermetic container. A multiple electron beam source was thus produced. Then the outer enclosure (hermetic container) was sealed by heating the exhaust tube not shown in the figures with a gas burner to be deposited at the vacuum degree on the order of $10^{-6}$ [Torr ($1.33\times10^{-4}$ Pa)].

Finally, a getter processing was conducted to maintain the vacuum degree in the hermetic container after sealing.

In a image display using the display panel shown in FIGS. 8 and 9 thus completed, an image is displayed in such a manner that electrons are emitted by applying scanning signals and modulation signals to each cold cathode element (surface conduction type electron emission device) 1012 from a signal generator not shown in the figures through the terminals Dx1 to Dxm and Dy1 to Dyn outside the hermetic container, the emitted electrons are accelerated by applying a high voltage to the metal back 1019 through a high voltage terminal Hv and caused to collide with the fluorescent film 1018, and the differently colored fluorescent substances 1301 (R, G, B in FIG. 14) are excited and caused to emit light. The voltage Va applied to the high voltage terminal Hv was increased slowly within the range from 3 [kV] to 12 [kV] to a threshold voltage at which electric discharge occurred. The voltage Vf applied between the wiring electrodes 1013 and 1014 was 14 [V]. The withstand voltage was judged to be satisfactory as long as a continuous driving is possible for 1 hours or longer when applying a voltage of 8 kV or higher to the high voltage terminal Hv.

Under such conditions, withstand voltage was satisfactory in the vicinity of spacer A. And lines of emission spots, including the spots formed by the electrons emitted from the cold cathode elements 1012 in the vicinity of spacer A, were made in such a manner that they were spaced at regular intervals in a two-dimensional form. And a color image display excellent in visibility and color reproducibility was obtained. This suggests that the installation of spacer A did not generate the disorder of the electric field which would affect the electron orbits.

Example 2

Low-alkali Substrate, Board-shaped, Ruthenium Oxide

As an original, used was a low-alkali glass substrate, which was subjected to injection molding and mirror surface polishing so that its outside dimensions of thickness, height and length would be 0.2 mm, 3 mm, and 40 mm, respectively. The average roughness of the substrate surface thus formed was 100 Å. Hereinafter the substrate is referred to as g0. Prior to deposition processing, the above spacer substrate g0 was subjected to first ultrasonic cleaning in deionized water, IPA and acetone for 3 minutes, then drying at 80° C. for 30 minutes, and followed by UV ozone cleaning so as to remove organic residues on the surface of the substrate.

Figure 3A:
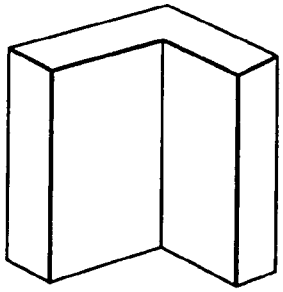
FIGS. 3A and 3B are illustrations of still another form of a spacer embodying the present invention.
Figure 3B:
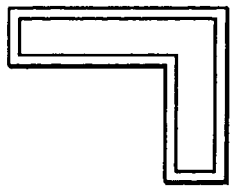
Figure 4:
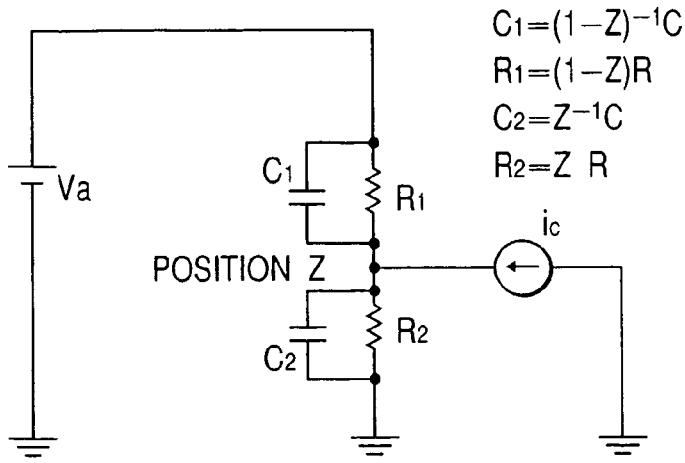
FIG. 4 is a schematic diagram showing a basic model for the calculation of charged electric potential considering the effects of secondary electron emission.
Figure 5:
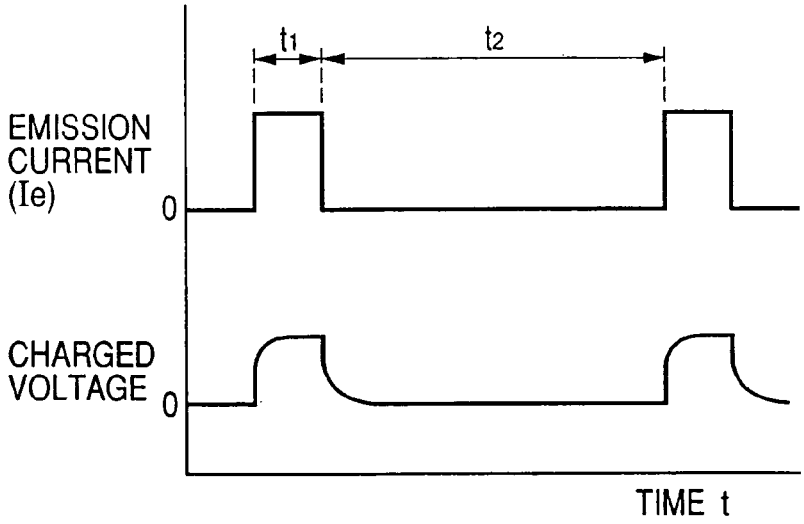
FIG. 5 is a schematic presentation of one example of the relationship between charged voltage and driving time illustrating the accumulation effects of electrification.
Figure 6:
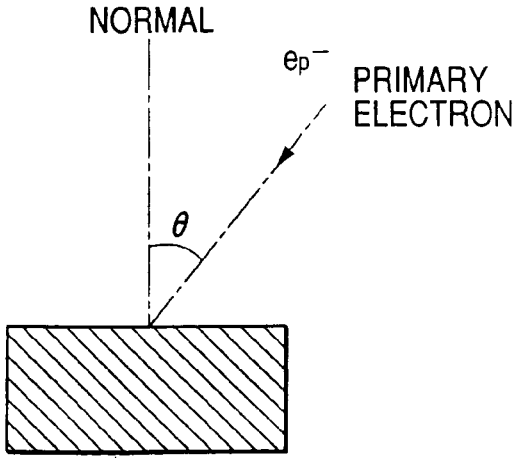
FIG. 6 is an illustration of an incident angle of primary electrons and a distribution of secondary electron emission.

Then the surface was coated with a highly resistive film and a low resistive film was partly formed thereon in the same manner as Example 1, except that the above glass substrate g0 was used as a spacer substrate and that the upper limit of heating temperature was set for 600° C. almost corresponding to the softening point of the glass component as a first component. The substrate applicable to the present invention is not limited to this, but various types of substrates are applicable. For example, columnar substrates shown in FIGS. 2A and 2B and angular substrates shown in FIGS. 3A and 3B are applicable.

The film thickness obtained was 2 μm, the sheet resistivity was $10^9$ Ω/□, and the roughness of the film surface was 160 Å. The film coated the entire surface due to its step coverage and its continuity was satisfactory.

When observing the thus obtained film with a scanning electron microscope under a acceleration voltage of 10 kV, observed was a network structure of aggregated fine particles of ruthenium oxide, as in the case of Example 1.

Further a low resistive film was formed in the same manner as Example 1 by sputtering. Hereinafter the spacer thus obtained is referred to as Spacer B. The incident angle dependency coefficient of secondary electron emission coefficient $m_0$ of spacer B was 2.9 for the incident electron energy of 1 kV.

Further an electron emission apparatus together with a rear plate incorporated with electron mission elements were produced in the same manner as Example 1, and high voltage application and element driving were conducted under the same conditions as Example 1.

Under such conditions, withstand voltage was satisfactory in the vicinity of spacer B. And lines of emission spots, including the spots formed by the electrons emitted from the cold cathode elements 1012 in the vicinity of spacer B, were made in such a manner that they were spaced at regular intervals in a two-dimensional form. And a color image display excellent in visibility and color reproducibility was obtained. This suggests that the installation of spacer B did not generate the disorder of the electric field which would affect the electron orbits.

Although the present invention was applied to the board-shaped spacers in the above example, it was applicable to the spacers having various shapes, such as columnar spacers and angular spacers as shown in FIGS. 2A and 2B or 3A and 3B.

Comparative Example

Spacer with Uniform Component-based Film Deposited by Sputtering

A spacer on which a highly resistive film and a low resistive film were formed by sputtering was produced in the same manner as Example 1, except that metal oxide was deposited by sputtering as a highly resistive film. Hereinafter the spacer thus obtained is referred to as spacer f. The highly resistive film was formed according to the following process.

A Cr—Al alloy nitride film of 200 nm thickness, as an antistatic film, was formed on the surface of the substrate by co-sputtering the targets of Cr and Al with a high-frequency power source. The sputtering gas was a mixture of Ar to $N_2$ ratio of 1:2, and its total pressure was 1 mTorr ($1.33\times10^{-1}$ Pa). The sheet resistivity of the film formed by co-deposition was: $R/\square=2\times10^{9}\ \Omega/\square$.

Although the roughness of the film surface thus obtained was 300 Å, there was no peeling observed on the highly resistive film and its continuity was satisfactory. When observing the film with a scanning electron microscope, it was confirmed that the film was uniform and had no network structure on it even under a acceleration voltage of 20 kV. The incident angle dependency coefficient of secondary electron emission coefficient $m_0$ of spacer f was 10.5 for the incident electron energy of 1 kV.

Further an electron emission apparatus together with a rear plate incorporated with electron mission elements were produced in the same manner as Example 1, and high voltage application and element driving were conducted under the same conditions as Example 1.

Under such conditions, withstand voltage was satisfactory in the vicinity of spacer f, however an infinitesimal electric discharge was observed, though it was not so serious for the elements to fracture.

In addition, the emission spots caused by the electrons emitted from the cold cathode elements 1012 in the vicinity of spacer f were drawn up to the spacer f by a distance of 0.2 times as long as the pitch of a picture element. This suggests that the spacer was electrically charged, and the installation of spacer f generated the disorder of the electric field which would affect the electron orbits.

Comparing the surface geometry, incident angle dependency of secondary electron emission coefficient, displacement of emission point and anode withstand voltage with respect to spacers a0, and g0, and f of the comparative example, the electric contact, displacement of emission point and withstand voltage were all satisfactory in all the spacers. Thus spacers with antistatic and highly resistive film suitable for a vacuum-resistant spacer of the electron beam apparatus could be formed. The electric contact mentioned herein means contact of the highly restive film with the substrate wiring and the face plate wiring via a low resistive film. However, as compared with that of spacer f, the incident angle dependency coefficient $m_0$ of secondary electron emission coefficient of spacers a0 and g0 decreased by one-half or more. Thus the effect of restricting the electric charge due to the electrons entering the spacer at an angle was obtained in spacers a0 and g0. In addition, multiple emission phenomenon of secondary electrons was also restricted, accordingly a spacer having a good beam-stability and high discharge restriction ability was obtained.

In accordance with the embodiments described above, spacers can be provided in which not only the static charge caused by the direct incident electrons from the closest electron source, but the static charge caused by the cumulative generation of electrons reflected from the face plate and of electrons multiply emitted from the edge surface of the spacers due to the anode applied voltage are restricted by the effect of relaxing the incident angle and the effect of suppressing the cumulative incidence and discharge of the secondary electrons.

The above spacers make it possible to produce electron beam type image displays with high definition and long-term reliability in which displacement of emission points and creeping discharge both involved with static electricity are restricted.

Further, for the spacers described above, their resistance can be easily controlled by modifying conductive component to glass component mixing ratio or adding infinitesimal metal oxide. Further, since their film formation process can be implemented through coating process and heat drying process, the above spacers are advantageous in efficiency of material usage, simplicity and easiness of film forming process and low in cost as compared with the other antistatic films formed based on the deposition method using sputtering deposition apparatus.

According to the invention of the present application, in an electron beam apparatus, the effects of static charge on the members within a hermetic container can be relaxed. Thus, an image display with high definition and long-term reliability can be realized.

What is claimed is:

1. A method of producing a member for use in an electron beam apparatus comprising a hermetic container with an electron source in it to be arranged in said hermetic container, the method comprising the steps of:

arranging on a substrate a mixture of a first material and a second material formed from an electroconductive material, wherein a weight ratio of the first material to the second material is 4:1 to 1:1, and heating the substrate on which the mixture is arranged, at a temperature equal to or higher than the softening point of the first material, to make the second material eluting into a region of the first material and to form a three dimensional network structure of aggregated fine particles of the second material, having intermediately resistive regions.

2. A method of producing a member for use in an electron beam apparatus according to claim 1, wherein the second material contains at least one component selected from the group consisting of ruthenium oxide, Pd—Ag, carbon, molybdenum oxide, LaB-tin oxide, tantalum oxide, $MoSi_2$, $NbSi_2$, $TaSi_2$, and $M_2Ru_2O_{7-x}$, wherein M is any one of Bi, Pb and Al.

3. The method of producing a member for use in an electron beam apparatus according to claim 1 or claim 2, wherein said first material contains a glass component.

4. The method of producing a member for use in an electron beam apparatus according to claim 3, wherein said substrate has a softening point higher than that of said glass component.

5. The method of producing a member for use in an electron beam apparatus according to claim 1 or 2, wherein said substrate consists of non-alkali glass or low-alkali glass.

6. The method of producing a member for use in an electron beam apparatus to claim 1 or 2, wherein said substrate consists of ceramic material.

7. The method of producing a member for use in an electron beam apparatus according to claim 6, wherein said ceramic material contains zirconia.

8. The method of producing a member for use in an electron beam apparatus according to claim 7, wherein said ceramic material contains alumina as a main component.

9. The method of producing a member for use in an electron beam apparatus according to claim 6, wherein said ceramic material contains alumina as a main component.

* * * * *

UNITED STATES PATENT AND TRADEMARK OFFICE

CERTIFICATE OF CORRECTION

PATENT NO. : 7,281,964 B2
APPLICATION NO. : 11/136485
DATED : October 16, 2007
INVENTOR(S) : Nobuhiro Ito et al.

It is certified that error appears in the above-identified patent and that said Letters Patent is hereby corrected as shown below:

ON THE TITLE PAGE - References Cited:

OTHER PUBLICATIONS (56), After "G. Ditmer,", "Firms," should read --Films,--; After "Lectures on", "Technologyvol." should read --Technology vol.--; and After "Abe et al., Factors", "$R_uO_2$" should read --$RuO_2$--.

COLUMN 2:

Line 16, "Molybdenium" should read --Molybdenum--; and
Line 53, "heated" should read --being heated--.

COLUMN 3:

Line 66, "and" should be deleted.

COLUMN 5:

Line 42, "most" should be deleted; and
Line 59, "ic" should read --Ic--.

COLUMN 6:

Line 50, "$=\Sigma\Sigma(\delta_{ij}-1)x\beta^{ij}xIe$" should read --$=\Sigma\Sigma(\delta^{ij}-1)x\beta^{ij}xIe$--.

COLUMN 11:

Line 44, "reproductive" should read --reproducible--.

COLUMN 17:

Line 41, "materials" should read --material--;
Line 53, "comprising" should read --comprises--;
Line 54, "materials" should read --material--; and
Line 56, "characterized" should read --and is characterized--.

UNITED STATES PATENT AND TRADEMARK OFFICE

CERTIFICATE OF CORRECTION

PATENT NO. : 7,281,964 B2
APPLICATION NO. : 11/136485
DATED : October 16, 2007
INVENTOR(S) : Nobuhiro Ito et al.

It is certified that error appears in the above-identified patent and that said Letters Patent is hereby corrected as shown below:

COLUMN 20:

Line 5, “the direction.” should read --directions.--; and
Line 52, “emission” should read --emissions--.

COLUMN 21:

Line 37, “more doubled” should read --more than doubled--.

COLUMN 23:

Line 2, “angle” should read --angles--; and
Line 4, “characteristics” should read --characteristic--; and “are” should read --is--.

COLUMN 26:

Line 20, “devices On” should read --devices. ¶On--;
Line 54, “cross sectional” should read --cross-sectional--; and
Line 61, “devices” should read --device--.

COLUMN 27:

Line 65, “is” should read --are--.

COLUMN 30:

Line 31, “types” should read --types of--.

COLUMN 32:

Line 26, “describe” should read --described--.

COLUMN 33:

Line 16, “of that” should read --whose--.

UNITED STATES PATENT AND TRADEMARK OFFICE

CERTIFICATE OF CORRECTION

PATENT NO. : 7,281,964 B2
APPLICATION NO. : 11/136485
DATED : October 16, 2007
INVENTOR(S) : Nobuhiro Ito et al.

It is certified that error appears in the above-identified patent and that said Letters Patent is hereby corrected as shown below:

COLUMN 39:

Line 27, “an” should read --a--.

COLUMN 40:

Line 4, “produce” should read --produced--.

COLUMN 41:

Line 3, “of” should be deleted; and
Line 7, “more” should read --in more--.

COLUMN 43:

Line 60, “hours” should read --hour--.

COLUMN 45:

Line 54, “restive” should read --resistive--.

COLUMN 46:

Line 44, “three dimensional” should read --three-dimensional--;
Line 66, “to” should read --according to--.

Signed and Sealed this

Twenty-second Day of July, 2008

JON W. DUDAS
*Director of the United States Patent and Trademark Office*